United States Patent [19]

Parker et al.

[11] 4,331,091

[45] May 25, 1982

[54] THREE-DIMENSIONAL THICK FABRICS AND METHOD AND APPARATUS FOR MAKING SAME

[75] Inventors: Leon Parker, Burbank; Arthur R. Campman, Los Angeles, both of Calif.

[73] Assignee: Hitco, Irvine, Calif.

[21] Appl. No.: 86,655

[22] Filed: Oct. 22, 1979

[51] Int. Cl.[3] ..... D05B 97/00; D05B 1/10; D05C 15/00

[52] U.S. Cl. ..... 112/262.1; 112/163; 112/165; 112/79 R; 112/242

[58] Field of Search ..... 112/262.1, 262.2, 262.3, 112/165, 163, 242, 131, 48, 198, 438

[56] References Cited

U.S. PATENT DOCUMENTS

| | | | |
|---|---|---|---|
| 1,364,997 | 1/1921 | Kelso | 112/198 |
| 1,463,325 | 7/1923 | Kiewicz | 112/242 X |
| 1,714,928 | 5/1929 | Sigoda | 112/198 |
| 2,626,580 | 1/1953 | Koenig | 112/242 |
| 2,629,353 | 2/1953 | Hay | 112/48 |
| 2,994,631 | 8/1961 | Ottinger | 112/262.2 X |
| 3,353,510 | 11/1967 | Reeber et al. | 112/165 X |
| 4,077,340 | 3/1978 | Braun et al. | 112/131 |
| 4,175,499 | 11/1979 | Navlyt | 112/165 |

*Primary Examiner*—H. Hampton Hunter
*Attorney, Agent, or Firm*—Fraser and Bogucki

[57] ABSTRACT

Three-dimensional thick fabrics are made from a laminate of fabric plies by first inserting pointed rods through the laminate to form rows of holes after which needles are reciprocated through the different holes to pull loops of various yarns through the holes. The loops of yarns in adjacent holes are interlocked to hold the plies together. A guide releasably clamped to each yarn controls tension in the yarn while a doffing point is employed to insure that the needle passes through a loop just formed when penetrating the next hole to insure interlock of the loops. Hollow circular objects are formed by winding a length of fabric a selected number of times around a form, following which the pointed rods are used to form holes in the resulting laminate with the needles and yarns being used to form the interlocking loops through the thickness of the laminate. Where the hollow circular fabric laminate is of varying diameter, the fabric as woven is taken up by a roller of varying diameter proportioned to that of the form, while the fabric itself is varied in density across the width during weaving thereof by interweaving selected ones of the transverse fill yarns with the longitudinal warp yarns across only a selected portion of the width of the fabric.

10 Claims, 33 Drawing Figures

FIG. 1
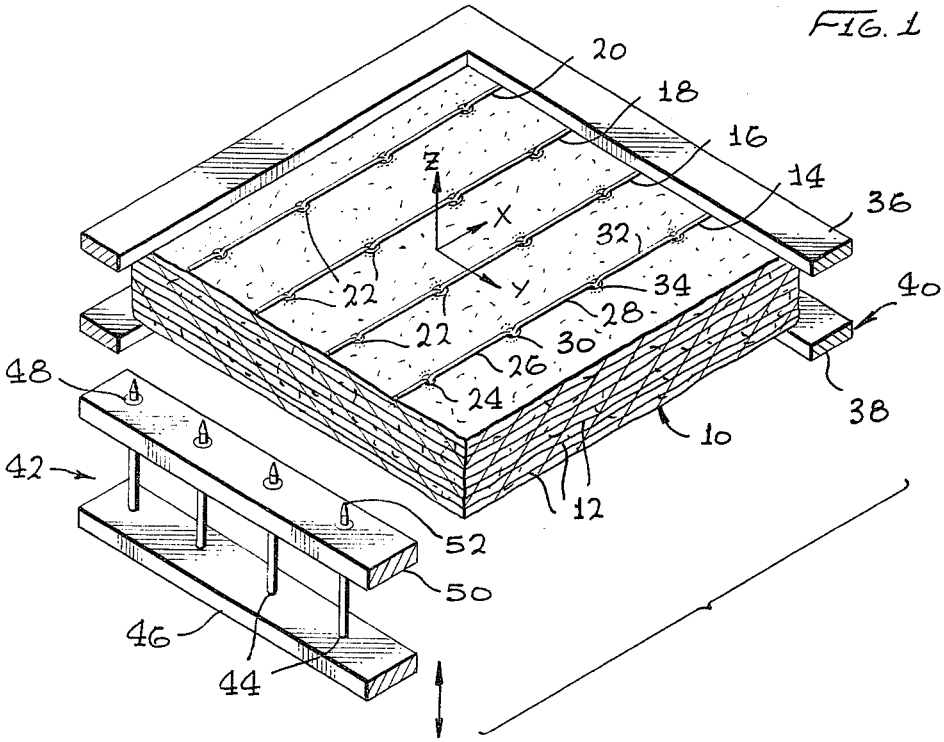
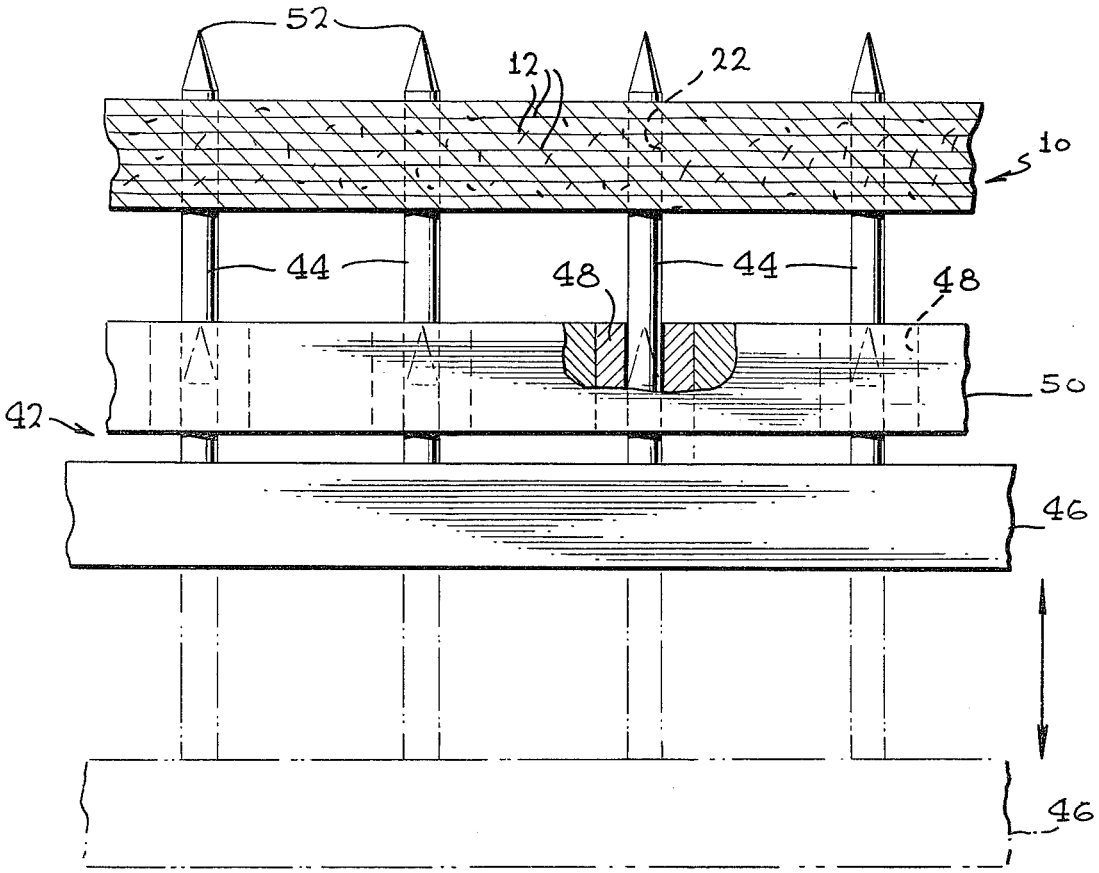
FIG. 2

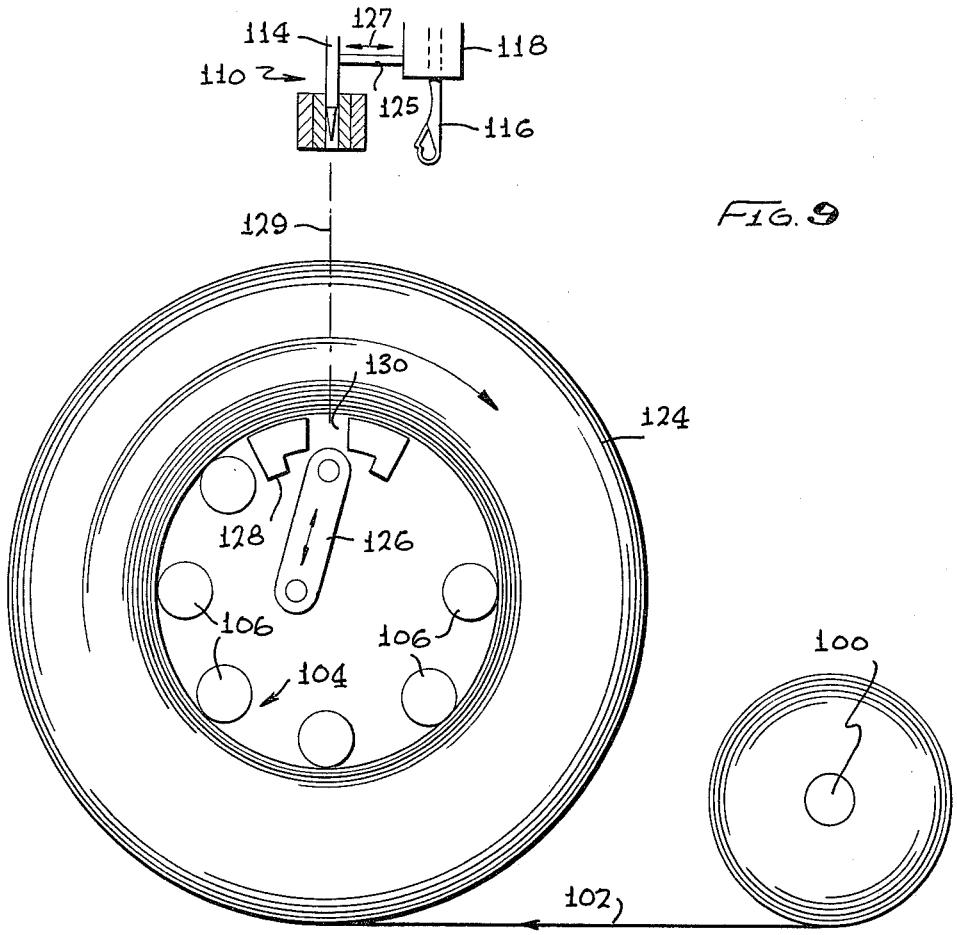
FIG. 9
FIG. 10A
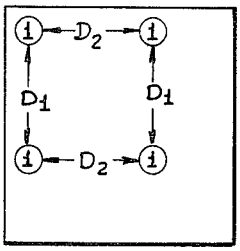
FIG. 10B
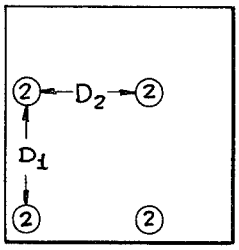
FIG. 10C
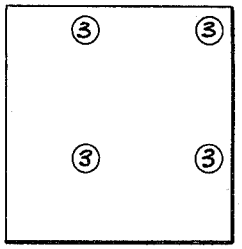
FIG. 10D
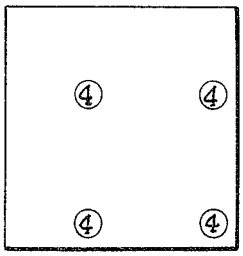
FIG. 10E
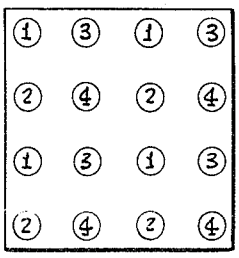

3.14"
176
6.91"
8.79"

20"
210
202
190
204
200
208
44"
56"
32" CYLINDRICAL
32" CONIC
24" OGIVE 254
45°
260
D
264
262
250
258
252
256
2"
12"

202
216
FILL DIRECTION
212
WARP DIRECTION
240
238
204
236
234
232
230
200
228
218
178
226
214
56 PICK REPEAT

FIG. 21
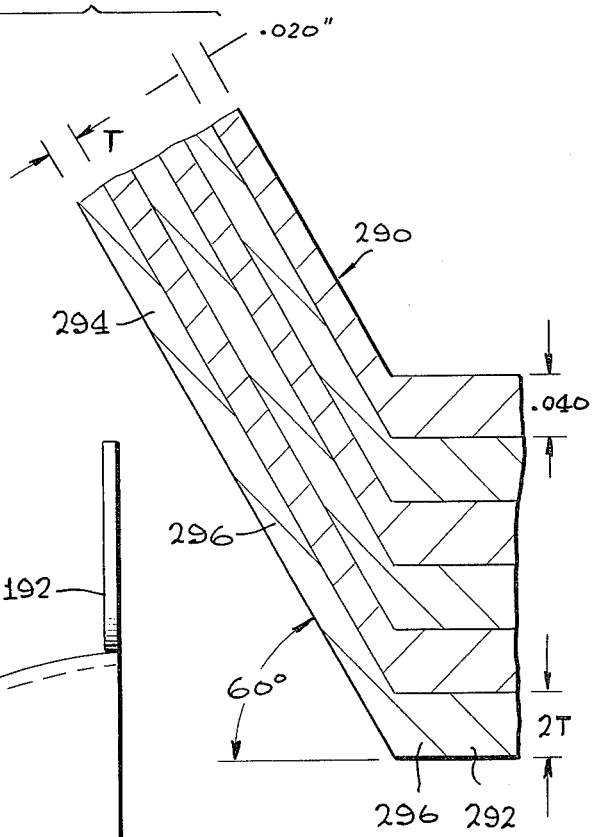
FIG. 22
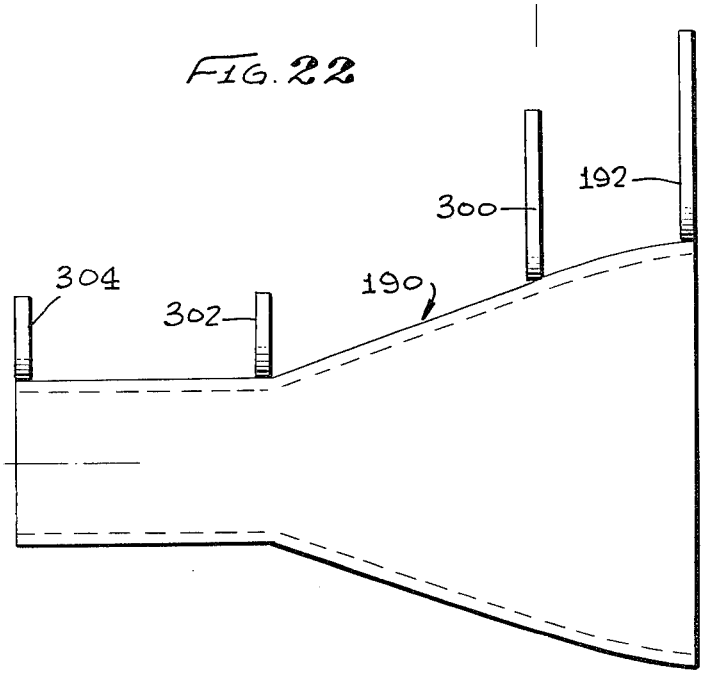
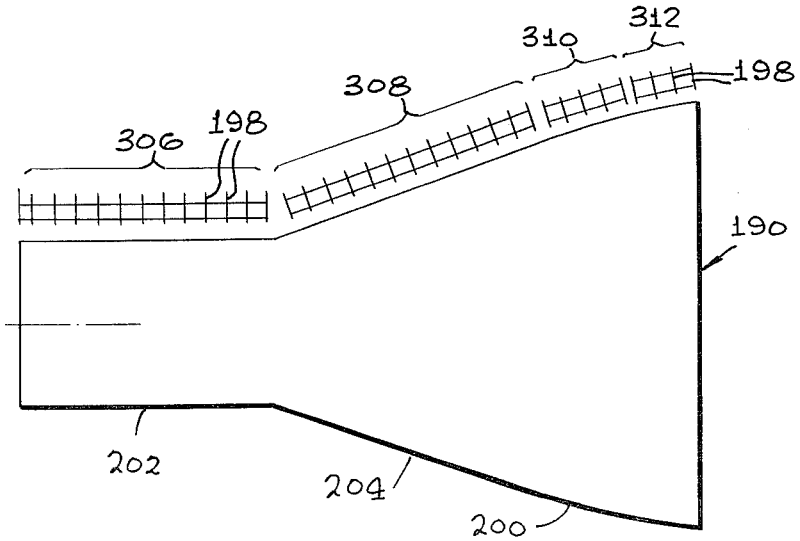
FIG. 23

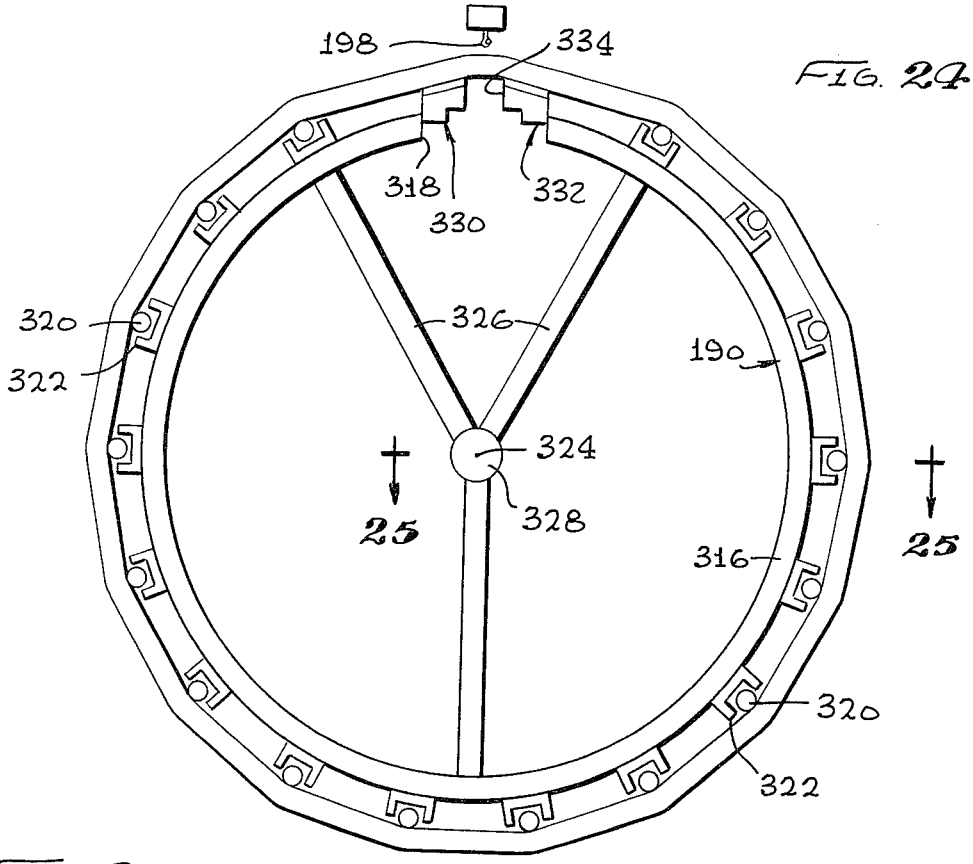
FIG. 24
FIG. 25
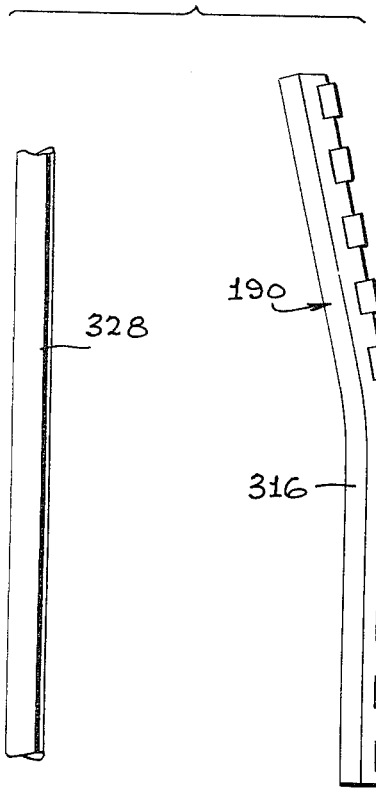
FIG. 26
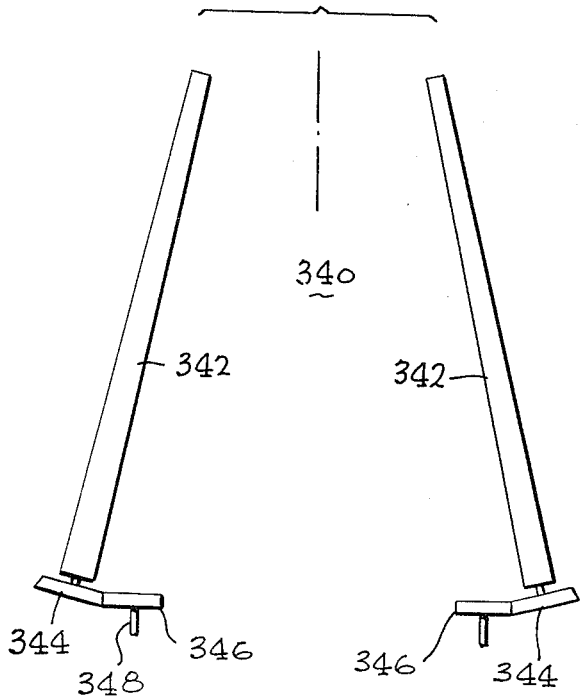

FIG. 27
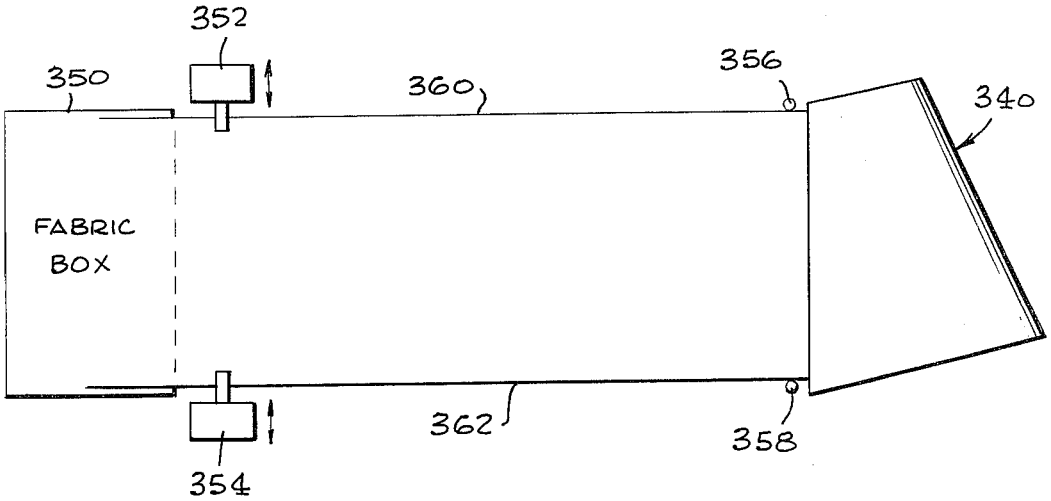
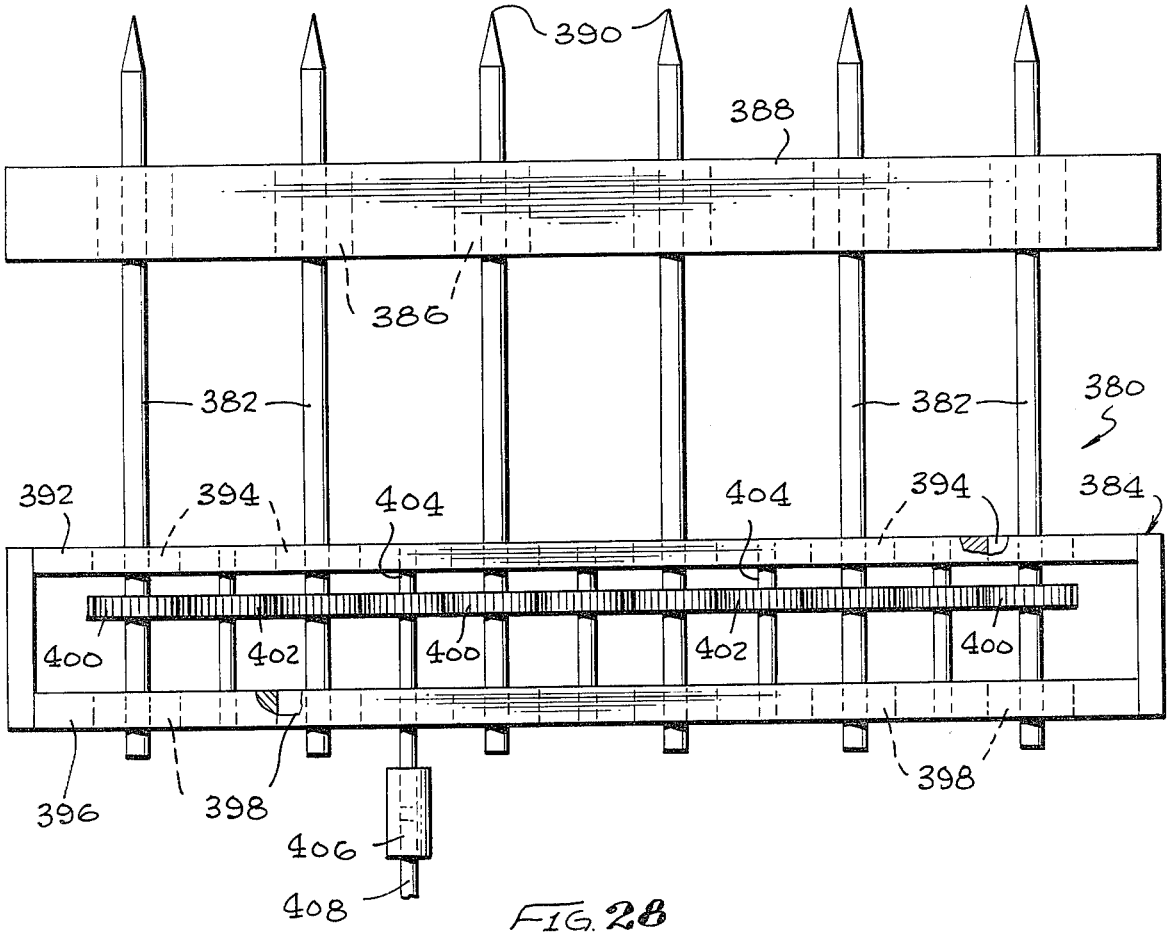
FIG. 28

THREE-DIMENSIONAL THICK FABRICS AND METHOD AND APPARATUS FOR MAKING SAME

BACKGROUND OF THE INVENTION

1. Field of the Invention

The present invention relates to three-dimensional thick fabrics, and more particularly to fabrics made from a laminate of different fabric plies made of yarns extending generally in two mutually perpendicular directions which is secured together by yarns extending through the thickness of the fabric in a third direction different from the first two directions.

2. History of the Prior Art

Three-dimensional thick fabrics are presently used in a variety of applications including such things as heat shields in aerospace applications. In the case of heat shields and other ablative components, the end component is preferably made from a thick fabric of carbonizable or carbon-containing yarns interwoven to form a three-dimensional fabric and thereafter impregnated with a thermosetting resin which is then cured and carbonized as desired to form a carbon-carbon composite.

To provide for structural integrity and other desired properites three-dimensional thick fabrics of the type used in ablative applications are preferably formed using three different yarn systems which extend in different directions and which are interwoven with one another. The three different yarn systems can be interwoven simultaneously on a flat loom or using a circular loom. Where a flat loom is used the yarns are interwoven to form a flat fabric which is then opened into the desired circular configuration. Disadvantages of such fabrics may include the inability to weave certain shapes or configurations in the flat and non-uniformities in the density or thickness of the resulting circular fabric including seam lines in many cases. An alternative is to weave the fabric in circular form such as by use of a circular loom. In such arrangements a first yarn system extends along the length of the circular fabric so as to be interwoven with a second yarn system extending generally circumferentially around the fabric with a third yarn system extending through the thickness of the fabric walls so as to be interwoven with both the first and second yarn systems. Such circular loom arrangements are capable of weaving seamless circular fabrics of relatively uniform density. However, the procedure is relatively slow and expensive.

Because of the disadvantages in weaving threedimensional thick fabrics in the flat or using a circular loom, considerations such as cost frequently dictate that the fabrics be made from a laminate of plies of two-dimensional fabric held together by a third yarn system or its equivalent. It is known, for example, to wrap a tape in which yarns extend longitudinally and transversely or alternatively at a bias angle around a mandrel or other form to a desired thickness. It is also known to cut patterns of fabric from preimpregnated material and to stack the patterns of fabric in interleaved fashion and at an angle around a form. In a still further prior art technique a multi-ply laminate is formed, following which holes are drilled through the thickness of the laminate with rods being inserted in the hole to maintain the integrity of the laminate. This technique involves certain disadvantages including some reduction in the strength of the resulting laminate due to removal of portions of the yarns as the holes are drilled through the laminate. It is also known to stitch a laminate of plies of fabric or other material together. Various techniques therefor and needles and other apparatus used in connection therewith are shown by U.S. Pat. Nos. 461,793 of Briggs, 3,649,428 of Hughes, 3,224,399 of Lightner et al, 3,468,274 of Koffler, 437,083 of Bennett, 3,222,891 of Wignall, 2,274,468 of Bell, 4,144,612 of Yamaguchi, Re. 18,954 of Fox, 2,982,242 of Wolf and 4,154,061 of Umemoto et al. Many generalized techniques including some of the various techniques shown in the above patents have not been successfully employed in making three-dimensional thick fabrics of the type suited for ablative and similar applications. This is due to a number of factors including the difficulty in applying techniques of the type shown in the art designed for use with different types of materials to the carbonizable yarns and weaving techniques typically used in conjunction therewith to make three-dimensional thick fabrics for ablative and similar applications.

Further problems arise in the manufacture of three-dimensional thick fabrics which are of hollow, circular configuration and which have a varying diameter. Heat shields, for example, may assume complex shapes which include ogive shapes, conical sections and cylinders, sometimes all in the same part. Such shapes are extremely difficult if not impossible to weave in the flat and are difficult to make and therefore extremely costly using a circular loom.

Accordingly, it is an object of the invention to provide improved three-dimensional thick fabrics and methods and apparatus for making the same.

It is a further object of the invention to provide an improved method and apparatus for securing a laminate of fabric plies together using a third yarn system to form a three-dimensional thick fabric.

It is a still further object of the invention to provide improved three-dimensional thick fabrics of hollow circular configuration and methods and apparatus for making the same.

It is a still further object of the invention to provide improved three-dimensional thick fabrics of hollow, circular configuration and of varying diameter, and methods and apparatus for making the same.

BRIEF DESCRIPTION OF THE INVENTION

These and other objects are accomplished in accordance with the invention by first forming a laminate of individual fabric plies. The laminate may be flat or it may be in a hollow, circular or other desired shape. Pointed rods are then repeatedly pushed through the thickness of the laminate as the rods are advanced along the length of the laminate to form rows of holes in the laminate. A row of needles is advanced along the rows of holes as they are formed. Upon reaching each row of holes, the needles are extended through the holes to secure yarns on the opposite side of the laminate, following which the needles are pulled back through the holes, thereby pulling loops of the yarns through the holes. The needles are then extended through the loops formed thereby and into the next row of holes to again secure the yarns and pull loops thereof through the holes. In this manner loops of the yarns in adjacent holes are interlocked.

Each securing of the yarns by the needles and the subsequent formation of loops in the yarns by the needles is facilitated by guide bars which releasably clamp the yarns to vary the tension therein. The guide bars repeatedly clamp the associated yarns which pass through eyelets therein to provide a slack length of each yarn for greater ease in hooking the yarn with the needle and pulling a loop of the yarn back through the hole. Passage of each needle through the loop just formed thereby is insured through the use of doffing points. Each yarn loop just formed by a needle is held by a doffing point until the needle is passed through the loop and into the next hole in the laminate. The needles are preferably of the latch type or similar configuration so as to be able to secure the yarns when extended through the holes and then release the yarn loop formed thereby upon movement into the next hole.

Three-dimensional thick fabrics of hollow, circular configuration are made in accordance with the invention by winding a length of woven fabric onto a hollow, circular form a desired number of times to form a laminate of desired thickness. The laminate so formed is then repeatedly advanced relative to a row of pointed rods mounted on the outside thereof and which repeatedly penetrate the laminate to form the rows of holes therein. A row of needles mounted inside the form and the laminate carried thereby, or alternatively on the outside of the laminate where interior space does not permit, extend back and forth through each row of holes formed by the pointed rods to pull loops of yarns through the thickness of the laminate in the manner previously described.

In one alternative technique for forming the yarn loops through the thickness of the laminate, the length of woven fabric is wound onto the form to a first desired thickness, at which point holes are formed in the resulting laminate and yarn loops are formed therein. Thereafter, the process is repeated one or more times with the length of fabric being wound around the form a desired number of times and holes being formed and yarn loops extended therethrough. Each time the process is repeated, however, the new holes are formed in a different location from the prior holes.

In an alternative arrangement for varying the tension on the yarns being formed into loops through the thickness of the laminate the yarns are drawn over a spring-loaded roller and between a pair of mating rollers which sandwich the yarns therebetween. The mating rollers are advanced at a controlled rate and are releasably engaged to vary the tension of the yarns as they are formed into the loops pulled through the thickness of the laminate and then tightened to secure the plies of the laminate together.

In accordance with the invention three-dimensional thick fabrics of hollow circular configuration which are of complex shapes so as to have a varying diameter along the length thereof are formed by apparatus which weaves a length of fabric using a take up roller which has a varying diameter along the length thereof proportional to the diameter of the circular configuration of the thick fabric. A laminate of the fabric is formed on a hollow form, following which holes are created in the laminate and yarn loops are formed and interlocked through the laminate thickness in the manner previously described. The roller takes up the longitudinal wrap yarns during weaving in accordance with the varying diameter thereof such that the fabric length at every position across the fabric width is proportional to the circumference of the hollow circular configuration at that relative position, with the overall fabric length being that required to wind the laminate to the required number of plies. Desired fabric nonuniformity of varying density is provided during the weaving of the fabric by interweaving some of the transverse fill yarns with the longitudinal wrap yarns of the fabric being formed across only a portion of the width of the fabric. The length of the interweavings of various ones of the fill yarns across the width of the fabric is typically varied in accordance with a pattern to achieve a desired effect.

A shifting point of diameter change in the making of certain fabric shapes as the fabric is repeatedly wound around the form can be compensated for in accordance with the invention by a roller a portion of which is varied in diameter as the fabric is woven. One such roller in accordance with the invention is comprised of a plurality of wedge-shaped sectors which surround a central shaft and which are engaged by opposite nuts of varying diameter threaded onto the opposite ends of the shaft. Movement of the nuts toward one another causes the nuts to engage the sectors, thereby forcing portions of the sectors outwardly and away from the central shaft so as to increase the diameter of a portion of the roller.

The fabric from the roller can be fed onto the form using a plurality of driven wheels engaging the fabric laminate opposite the form. The wheels which are spaced along the length of the form have a diameter which is proportional to the diameter of the form at the point where the wheel contacts the laminate, thereby enabling the various wheels to be driven at the same speed.

Where the form assumes a complex shape such as one of varying diameter, a row of needles mounted on the outside of the form for pulling loops of thread through the thickness of the laminate is broken into different segments so as to generally conform to the outer surface of the form. The form itself may consist of a hollow frame mounting a plurality of cylindrical rollers on the outside thereof. The rollers which are rotatable around axes extending generally in the direction of the length of the form receive the fabric as it is wound onto the form and enable the resulting laminate to be rotated around the outside of the form as the laminate is sewed together with the loops of yarn.

Where the three-dimensional thick fabric being formed assumes the shape of a hollow, conical section, the form can be comprised of a plurality of tapered rollers disposed about the outer periphery thereof with each roller extending along the length of the form. One or more of the rollers can be driven as necessary to rotate the fabric laminate formed therearound.

BRIEF DESCRIPTION OF THE DRAWINGS

The foregoing and other objects, features and advantages of the invention will be apparent from the following more particular description of preferred embodiment of the invention, as illustrated in the accompanying drawings, in which:

FIG. 1 is a perspective view of a three-dimensional thick fabric in accordance with the invention together with a portion of the apparatus used for making the same;

FIG. 2 is a side sectional view of an arrangement of pointed rods shown in FIG. 1;

FIG. 9 is a side view of an arrangement similar to that of FIG. 8 but modified so as to accommodate the formation of a very thick fabric;

FIGS. 10A–10E comprise plan views of a portion of a fabric laminate illustrating an alternative technique for perforating and then sewing the laminate together with yarn loops as it is formed;

FIG. 21 is a sectional view of a portion of a three-dimensional thick fabric illustrating other problems which may be encountered when forming fabrics of complex shape;

FIG. 22 is a top view of a fabric laminate formed on the form of FIG. 13 and illustrating an arrangement for wrapping the fabric around the form;

FIG. 23 is a top view of the fabric laminate and form of FIG. 22 illustrating a particular arrangement of needles used to sew the plies of the fabric laminate together;

FIG. 24 is an end view of one particular arrangement of a form which can be used in the arrangement of FIG. 12;

FIG. 25 is a sectional view of FIG. 24 taken along the line 25—25 thereof;

FIG. 26 is a top view of a portion of an alternative arrangement of a form for making a three-dimensional thick fabric in the form of a hollow conical section;

FIG. 27 is a plan view of an arrangement for making a three-dimensional thick fabric using the form of FIG. 26; and FIG. 28 is a side sectional view of an alternative arrangement of pointed rods in which the rods rotate.

DETAILED DESCRIPTION

Figure 3A:
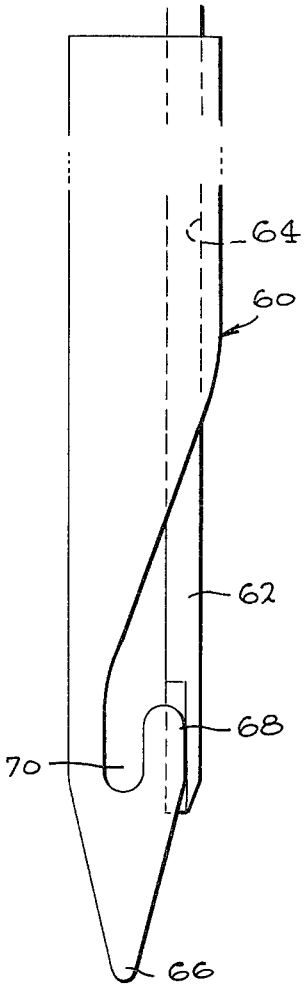
FIG. 3A is a side view of one type of needle which can be used in making the fabric of FIG. 1, the needle being shown in a first position.

FIG. 1 depicts a three-dimensional thick fabric 10 in accordance with the invention. The fabric 10 comprises a laminate of individual fabric plies 12 stacked one on top of the other to provide the fabric 10 with a desired thickness. Each of the fabric plies 12 is woven in conventional fashion from two different yarn systems extending in mutually orthogonal directions so as to provide the fabric 10 with yarns extending in X and Y directions.

The fabric plies 12 are secured together by yarns extending in the Z direction so as to form generally right angles with the X and Y direction yarns in each of the plies 12. There are four Z direction yarns 14, 16, 18 and 20 shown in FIG. 1. The yarns 14, 16, 18 and 20 extend in the Z direction through rows of holes 22 in the fabric 10. At the top of each hole 22 the Z direction yarn 14, 16, 18 or 20 forms a loop which is interconnected or interlocked with another loop in the same yarn extending through an adjacent hole. For example, in the case of the Z direction yarn 14, the yarn 14 extends out of a hole 24 to form a loop 26. The loop 26 is interlocked with a loop 28 extending out of a hole 30 adjacent the hole 24. In like fashion, the loop 28 is interlocked with a loop 32 extending out of a hole 34 adjacent the hole 30.

The Z direction yarns are shown and described as lying along the Z acis so as to be normal to the opposite broad surfaces of the fabric. However, such yarns need not lie along the Z axis but can extend through the fabric 10 at an angle such as 15° or 30° with the Z axis. Accordingly, Z axis yarns as referred to hereafter need not necessarily be normal to the fabric surfaces so long as they extend through the thickness of the fabric. In the example of FIG. 1 the fabric 10 is secured by opposite members 36 and 38 of a frame 40. The frame 40 is used in making the fabric 10. After forming a loose laminate of the fabric plies 12, the laminate is secured in place by the opposite members 36 and 38 of the frame 40. Although the opposite members 36 and 38 are only shown as extending around two sides of the fabric 10 in FIG. 1, such members typically extend around all sides of a fabric to be formed so as to securely clamp the laminate of fabric plies 12 for processing thereof.

The holes 22 lie in a succession of rows along the length of the fabric 10. The holes in each row are simultaneously formed by a hole forming mechanism 42 which is shown in FIG. 1 and in detail in FIG. 2. The hole forming mechanism 42 includes a plurality of pointed rods 44 arranged into a row and mounted in generally parallel, spaced-apart relation along the length of a mounting bar 46. The individual rods 44 are received within different bushings 48 mounted in spaced-apart relation along the length of a rod guide bar 50. When the mounting bar 46 is moved toward and away from the rod guide bar 50, pointed tips 52 at the upper ends of the rods 44 extend upwardly from the rod guide bar 50 as the rods 44 are moved through the bushings 48 in the guide bar 50. The rod guide bar 50 of the hole forming mechanism 42 is mounted by appropriate apparatus for movement adjacent to the fabric 10 along the length of the fabric 10. Periodically, the mounting bar 46 is moved upwardly toward the rod guide bar 50 to push the rods 44 through the entire thickness of the fabric 10 to form a row of the holes 22. When the rods 44 have penetrated the entire thickness of the fabric 10, the mounting bar 46 is pulled downwardly and away from the rod guide bar 50 to remove the rods 44 from the fabric 10. The pointed tips 52 of the rods 44 slide relatively easily and gently through the thickness of the fabric 10 by spreading apart the X and Y yarns of each fabric ply 12 as necessary to form a hole through the thickness of the fabric 10. When the rods 44 are removed from the fabric 10 the holes 22 remain, at least long enough for the various Z direction yarns 14, 16, 18 and 20 to be looped through the holes 22 and interlocked as described hereafter.

FIG. 2 depicts the hole forming mechanism 42 in its two different operative positions. The rod guide bar 50 remains in the same position in each case since it remains a substantially fixed distance from the fabric 10. With the hole forming mechanism 42 in a withdrawn position, the rods 44 and the mounting bar 46 assume positions shown in dotted outline in FIG. 2. When the mounting bar 46 is moved toward the rod guide bar 50 so as to push the rods 44 through the thickness of the fabric 10 to form the holes 22, the rods 44 and rod guide bar 50 assume positions shown in solid outline in FIG. 2. Upon formation of each row of the holes 22 through such movement, the mounting bar 46 is moved outwardly and away from the rod guide bar 50 to remove the rods 44 from the fabric 10 so that the rods 44 and the mounting bar 46 assume the positions shown in dotted outline in FIG. 2. The fabric 10 is then incremented relative to the hole forming mechanism 42 to the next hole forming position, whereupon the mounting bar 46 is again reciprocated upwardly and then downwardly to puncture the fabric 10 with the rods 44 and form the next row of holes 22.

Figure 3B:
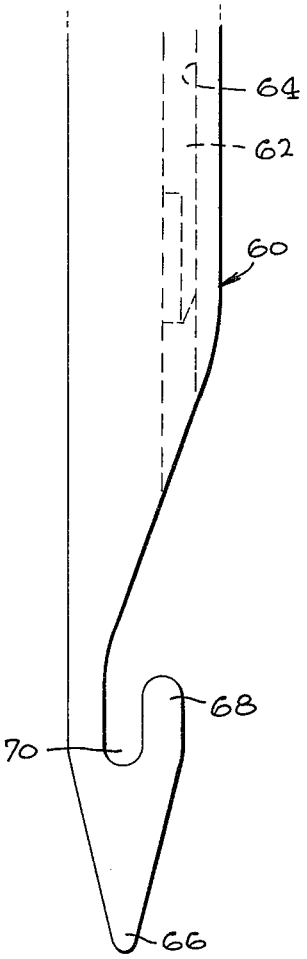
FIG. 3B is a side view of the needle of FIG. 3A shown in a second position.

Upon formation of each hole 22 in the fabric 10, a needle is extended through the hole 22 to the opposite side of the fabric 10 where the needle is secured to one of the Z direction yarns 14, 16, 18 and 20. The needle is then pulled back through the hole so as to pull with it a loop of the Z direction yarn. FIGS. 3A and 3B show one form of a needle 60 which can be used for this purpose. The needle 60 is a conventional wire type of needle such that it includes a length of wire 62 mounted for sliding movement within an aperture 64 extending along the length of the needle 60. The needle 60 terminates in a pointed tip 66 for ease of penetration of the needle through a laminate of fabric plies. The rear portion of the pointed tip 66 terminates in a lug 68 so as to form a hook 70 of appropriate configuration for receiving a length of yarn therein. The hook 70 is either closed or opened depending upon the position of the wire 62 within the needle 60. FIG. 3A depicts the closed position in which the wire 62 is moved forward within the aperture 64 so as to engage the lug 68 and close off the hook 70. With the wire 62 moved away from the lug 68, the hook 70 is open as shown in FIG. 3B.

A needle such as the needle 60 which can be selectively opened and closed is used in accordance with the invention to secure a Z direction yarn, pull a loop of the yarn through one of the holes 22, and then release the loop as the needle is inserted in the next hole 22. This is described hereafter in connection with FIGS. 5–7.

Figure 4:
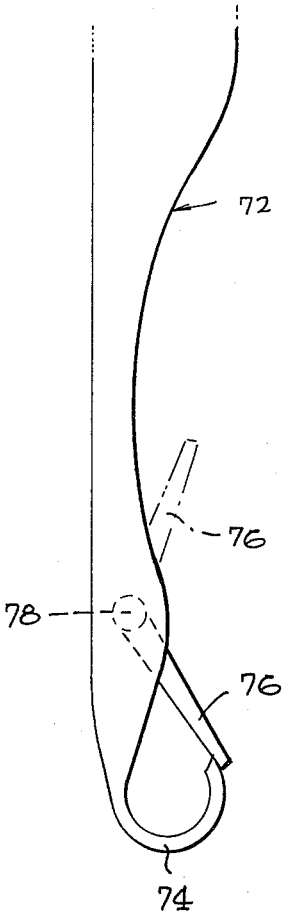
FIG. 4 is a side view of a different type of needle from that of FIGS. 3A and 3B which can be used to make the fabric of FIG. 1.

FIG. 4 depicts an alternative and preferred form of a needle 72 which is of the conventional latch type. The needle 72 has a hook 74 at the end thereof. An elongated latch 76 is pivotably mounted on the needle 72 at a point 78 removed from and behind the hook 74. The latch 76 is operated in conventional fashion so as to be pivoted between a closed position shown in solid outline in FIG. 4 and an open position shown in dashed outline in FIG. 4. With the latch 76 in the closed position a yarn within the hook 74 is secured in place. With the latch 76 in the open position, the hook 74 is open and the yarn may be removed therefrom.

Figure 5:
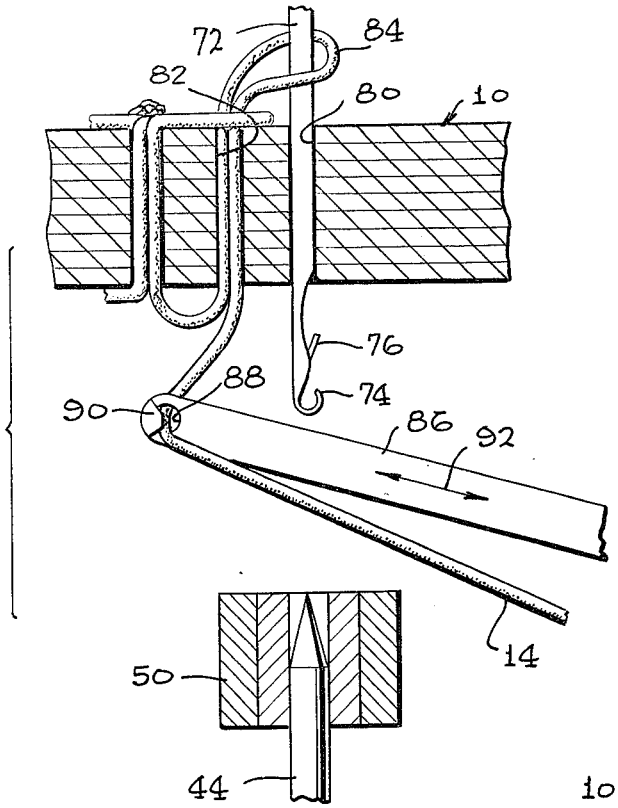
FIGS. 5–7 are different sectional views of a fabric laminate similar to the fabric of FIG. 1 and illustrating different steps and apparatus used in making the fabric.
Figure 6:
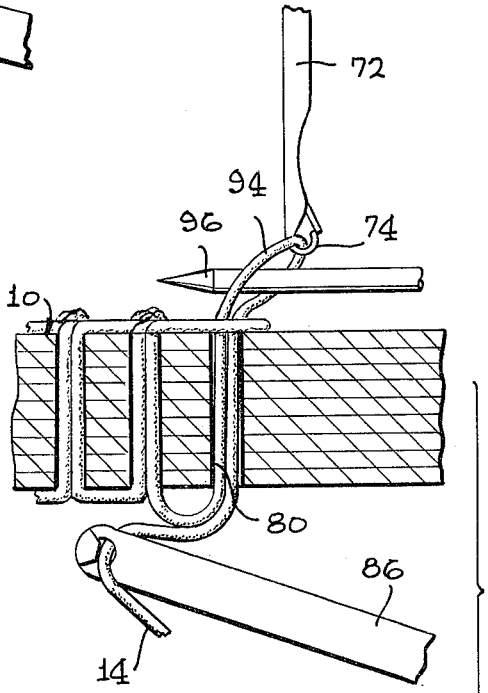
Figure 7:
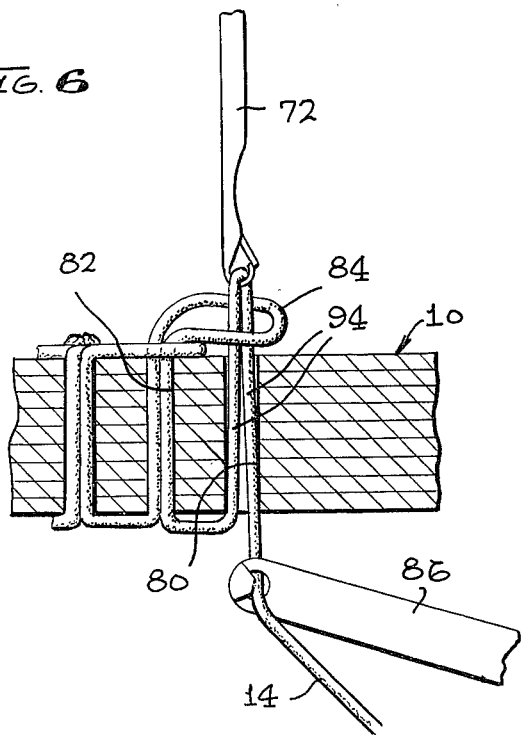
Figure 7:
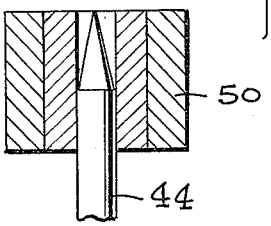

FIGS. 5, 6 and 7 depict three different steps in the process of inserting the Z direction yarns 14, 16, 18 and 20 in the holes 22 formed in the fabric 10. Referring first to FIG. 5, it is assumed that the pointed rod 44 has just formed a hole 80 in the fabric 10 after forming a prior hole 82. The Z direction yarn 14 is shown as having a loop 84 therein which has been pulled through the hole 82. The latch needle 72 of FIG. 4 extends downwardly through the hole 80 to the bottom side of the fabric 10.

An elongated guide bar 86 controls the feeding of the Z direction yarn 14 to the fabric 10. The yarn 14 passes through an eyelet 88 formed in the end of the guide bar 86 adjacent a releasable clamp 90. The clamp 90 selectively clamps the yarn 14 to the guide bar 86 at the eyelet 88 or alternatively allows the yarn 14 to pass freely through the eyelet 88. The guide bar 86 is mounted to reciprocate bidirectionally along the axis of elongation thereof as shown by an arrow 92. By clamping the yarn 14 to the guide bar 86 by the clamp 90 and advancing the guide bar 86 to the left as seen in FIG. 5 a length of the yarn 14 approximately equal to the thickness of the fabric 10 is advanced from the supply for the yarn 14. When the guide bar 86 reaches the position shown in FIG. 5, the clamp 90 is released, permitting the yarn 14 to pass freely through the eyelet 88 as the guide bar 86 is moved to the right as seen in FIG. 5. As the guide bar 86 is moved to the right, the slackened portion of the yarn 14 extending between the bottom of the hole 82 and the eyelet 88 within the guide bar 86 is placed within the hook 74 in the needle 72 and the latch 76 is thereafter closed to secure the yarn 14 within the hook 74. The needle 72 is then pulled upwardly back through the hole 80 in the fabric 10. This pulls a loop 94 of the yarn 14 through the hole 80 as shown in FIG. 6. Since the needle 72 is still within the prior loop 84, the new loop 94 is pulled upwardly and through the prior loop 84 so that the two loops 84 and 94 from the adjacent holes 82 and 80 interlock.

When the loop 94 in the yarn 14 has been pulled up through the prior loop 84, a doffing point 96 shown in FIG. 7 is inserted in the loop 94. The needle 72 and the pointed rod 44 are advanced to the next position along the length of the fabric 10 which is shown in FIG. 7. The pointed rod 44 is then used to create the next hole in the fabric 10, following which the needle 72 is lowered through the newly created hole into the position shown in FIG. 5. Prior to the lowering of the needle 72 through the newly formed hole, the latch 72 thereof is opened so that the needle 72 is free to slide downwardly through the loop 94 in the yarn 14. The presence of the doffing point 96 which can alternatively comprise a casting-off tool prevents the loop 94 from falling out of the hook 74 of the needle 72 as the latch 76 is opened. The needle 72 may then be moved downwardly through the loop 94 and through the newly formed hole in the fabric 10 to the position shown in FIG. 5, whereupon the steps of FIGS. 5–7 are repeated.

It was noted in connection with FIG. 5 that the guide bar 86 had clamped the yarn 14 thereto via the clamp 90 and the guide bar 86 had been moved to the left as seen in FIG. 5 to advance from the supply thereof a length of the yarn 14 approximately equal to the thickness of the fabric 10. The resulting slackness in the yarn 14 above the guide bar 86 facilitated engagement of the yarn 14 by the needle 72 and the pulling of a loop of the yarn 14 upwardly through the hole 80. The clamp 90 was then released and the guide bar 86 was moved to the right as seen in FIG. 5 until it reached the position shown in FIG. 6. With the new loop 94 pulled up through the old loop 84 as shown in FIG. 6, the clamp 90 once again secures the yarn 14 to the guide bar 86 and the guide bar 86 is moved to the left and into the position in FIG. 7. When the guide bar 86 reaches the position shown in FIG. 7, the clamp 90 releases the yarn 14 so that the slack length of the yarn 14 between the eyelet 88 and the hole 80 may be engaged by the needle 72 after extending the needle 72 downwardly through the hole in the fabric 10 about to be formed by the pointed rod 44.

Figure 8:
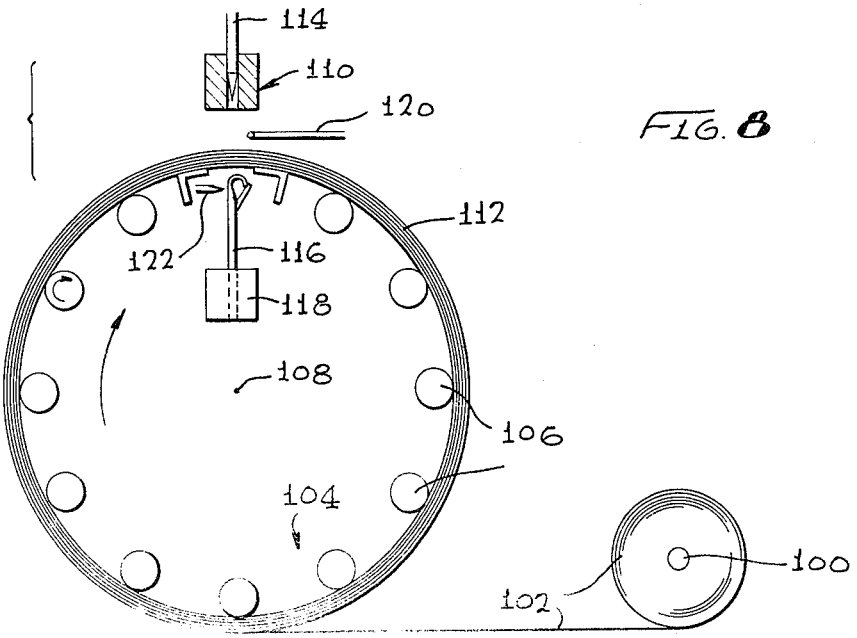
FIG. 8 is a side view of an arrangement for making a hollow, circular three-dimensional thick fabric in accordance with the invention.

An arrangement for making a three-dimensional thick fabric of hollow, circular configuration in accordance with the invention is shown in FIG. 8. A fabric supply roll 100 has a length of fabric 102 wound thereon. The fabric 102 is unwound from the roll 100 and is fed onto the outside of a form 104 comprising a plurality of rollers 106 arranged into a generally cylindrical configuration. The rollers 106 are mounted for rotation about axes generally parallel to a central axis 108 for the cylinder defined by the form 104. One or more of the rollers 106 may be rotatably driven or alternative means may be used to advance fabric 102 from the roll 100 around the form 104 a selected number of times to form a laminate of fabric plies.

When the fabric 102 has been wound around the form 104 of FIG. 8 the desired number of times, insertion of the Z axis yarns is accomplished. A hole forming mechanism 110 similar to the hole forming mechanism 42 of FIGS. 1 and 2 is mounted on the outside of a fabric 112 formed on the outside of the rollers 106. With the hole forming mechanism 110 mounted in a stationary position, the rollers 106 may be advanced in increments to advance the fabric 112 relative to a plurality of pointed rods 114 within the hole forming mechanism 110. The rods 114 are reciprocated in the manner previously described to form rows of holes in the fabric 112. Since the rods 114 of the hole forming mechanism 110 extend along the length of the form 104, each row of holes formed thereby is parallel to the central axis 108 of the fabric 112.

Upon formation of each row of holes in the fabric 112 by the hole forming mechanism 110, a row of needles 116 mounted in generally parallel, spaced-apart relation along the length of a mounting block 118 is moved into and then out of the holes in the manner described in connection with FIGS. 5–7 to secure a plurality of Z direction yarns within the fabric 112. As in the example of FIGS. 5–7 guide bars 120, one of which is shown in FIG. 8 and which are identical to the guide bar 86 of FIGS. 5–7, are used to advance the Z direction yarns in the desired manner. Also as in the example of FIGS. 5–7 doffing points 122, one of which is shown in FIG. 8 and which are identical to the doffing point 96 of FIGS. 5–7, are used to secure the loops of yarn pulled by the needles 116 through the fabric 112 until the needles 116 have been inserted into the next row of holes in the fabric.

The arrangement shown in FIG. 8 works well so long as there is sufficient space within the fabric 112 and at the inside of the form 104 to position and operate the needles 116. Where such space is inadequate such as may be due to the formation of a fabric of substantial thickness, then the needles 116 must be located on the outside of the fabric as shown in the arrangement of FIG. 9. The arrangement of FIG. 9 employs the fabric supply roll 100 to supply the length of fabric 102 to the form 104 comprised of the rollers 106. In the arrangement of FIG. 9 the rollers 106 are arranged to provide the cylindrical form 104 with a smaller diameter than in the arrangement of FIG. 8. It is also assumed that the length of fabric 102 is wound onto the form 104 a sufficient number of times to form a fabric 124 of substantial thickness. The hole forming mechanism 110 is disposed on a reciprocating mount 125 on the outside of the fabric 124. The needles 116 mounted on the common mounting block 118 are disposed on the outside of the fabric 124 adjacent the hole forming mechanism 110. The common mounting block 118 is also coupled to the reciprocating mount 125 which reciprocates in opposite directions shown by an arrow 127 to place either the rods 114 or the needles 116 at axes 129 which are radially disposed relative to the fabric 124. Reciprocation of the mount 125 enables the rods 114 to penetrate the fabric 124 along the axes 129 to form a row of holes, following which the needles 116 are positioned at the axes 129 to extend through the holes and pull yarn loops back through.

A plurality of guide bars 126 similar to the guide bar 86 of FIGS. 5–7 are located within the fabric 124 and adjacent an apertured guide 128. The guide 128 which is disposed between an adjacent pair of the rollers 106 and which is disposed against the inside surface of the fabric 124 opposite the hole forming mechanism 110 and the needles 116 supports the fabric 124 as the rods 114 are inserted through the fabric 124 and through apertures 130 in the guide 128 to form a row of holes in the fabric 124. The apertures 130 are large enough to freely pass the needles 116 as the needles 116 are subsequently extended through the holes to secure the Z direction yarns which are disposed on the inside of the fabric 124.

In the arrangements of FIGS. 8 and 9 the Z direction yarns all extend through the entire thickness of the fabric. An alternative technique in which some but not all of the Z direction yarns extend through the entire fabric thickness is illustrated in FIGS. 10A–10E. In the example of FIGS. 10A–10E it is assumed that the apparatus of FIG. 8 or FIG. 9 is used. The various different FIGS. 10A–10E depict the same square portion of the fabric as it is being formed, and it should be understood that the discussion with respect to the particular square portion of FIGS. 10A–10E applies to all or substantially all of the fabric.

The process depicted in FIGS. 10A–10E is begun by winding the fabric 102 from the roll 100 around the form 104 a selected number of times. The hole forming mechanism 110 and the needles 116 are then used in the manner previously described to insert the Z axis yarns through the resulting fabric. As shown in FIG. 10A adjacent pairs of the rods 114 in the hole forming mechanism 110 and adjacent pairs of the needles 116 are spaced apart by a distance $D_1$. At the same time the hole forming mechanism 110 and the needles 116 are incremented relative to the fabric so as to cover a distance $D_2$ with each incremental movement as shown in FIG. 10A. In the present example $D_2$ is chosen to be equal to $D_1$ so that in the particular square portion of the fabric shown in FIG. 10A four different stitches of the Z direction yarns are employed to form a square pattern.

Winding of the fabric 102 onto the form 104 is then continued until a further number of plies typically equal to the prior number of plies has been formed on the fabric. The process of FIG. 10A is then repeated except that the rods 114 of the hole forming mechanism 110 and the needles 116 are moved along the length of the form 104 a distance of one-half $D_1$. Otherwise the spacing between the rods 114 and the needles 116 remains at $D_1$ and the incrementing of the rods and needles continues to be $D_2$.

When the entire circumference of the fabric as thus formed has been stitched with the Z direction yarns, the fabric 102 is again wound onto the form 104 an additional number of times typically equal to the number of plies in the first two applications and the process of FIG. 10A is repeated. Unlike the process of FIG. 10B, in the process of FIG. 10C the rods 114 and the needles 116 remain in the same position relative to the length of the form 104 as in FIG. 10A. However the circumferential positions of the rods 114 and the needles 116 relative to the fabric are offset by a distance of one-half $D_2$, providing the Z yarn stitching pattern shown in FIG. 10C.

In the final process of the example of FIGS. 10A–10E, the fabric 102 is further wound onto the form 104 by a desired number of turns typically equal to the first three applications of the fabric. The rods 114 and the needles 116 are moved along the length of the form 104 by a distance equal to one-half $D_1$ as compared with FIG. 10A and at the same time are offset relative to the circumference of the fabric by a distance equal to one-half $D_2$, resulting in the Z yarn stitches shown in FIG. 10D.

FIG. 10E comprises an overlay of the four different Z direction yarns installed during the steps of FIGS. 10A–10D within the square area of the fabric depicted therein. The stitch pattern shown in FIG. 10E prevails over all or substantially all of the surface of the fabric. The Z yarn stitches labeled "1" in FIG. 10E are those corresponding to FIG. 10A. Similarly, the Z yarn stitches labeled "2", "3", and "4" correspond to FIGS. 10B, 10C and 10D respectively. In the present example the stitches "1" of FIG. 10A extend from a common surface in the form of the inside surface of the fabric through one-fourth the thickness of the fabric. The stitches "2" shown in FIG. 10B extend from the common or inside surface through one-half the thickness of the fabric. The stitches "3" shown in FIG. 10C extend through three-fourths of the thickness of the fabric from the inner surface. Finally, the stitches "4" shown in FIG. 10D extend through the entire thickness of the fabric from the inner surface to the outer surface thereof. Such an arrangement provides for a relatively strong and sturdy three-dimensional thick fabric while at the same time providing certain advantages such as in the application of such fabrics to the formation of heat shields where it may be desirable to minimize heat transfer through the thickness of the fabric by limiting the number of Z direction yarns which extend through the entire thickness of the fabric.

In order to minimize damage to the Z direction yarns during the handling and insertion thereof through the fabrics, it is desirable to maintain accurate control of the tension in the Z direction yarns. Just prior to positioning each Z direction yarn in the hook of the needle, the yarn requires little or no tension. Also, as the needle pulls a loop of the yarn through the fabric, little or no tension is needed. However, where a previously inserted loop must be tightened around a newly inserted loop, tension in the Z direction yarns is desired.

Figure 11:
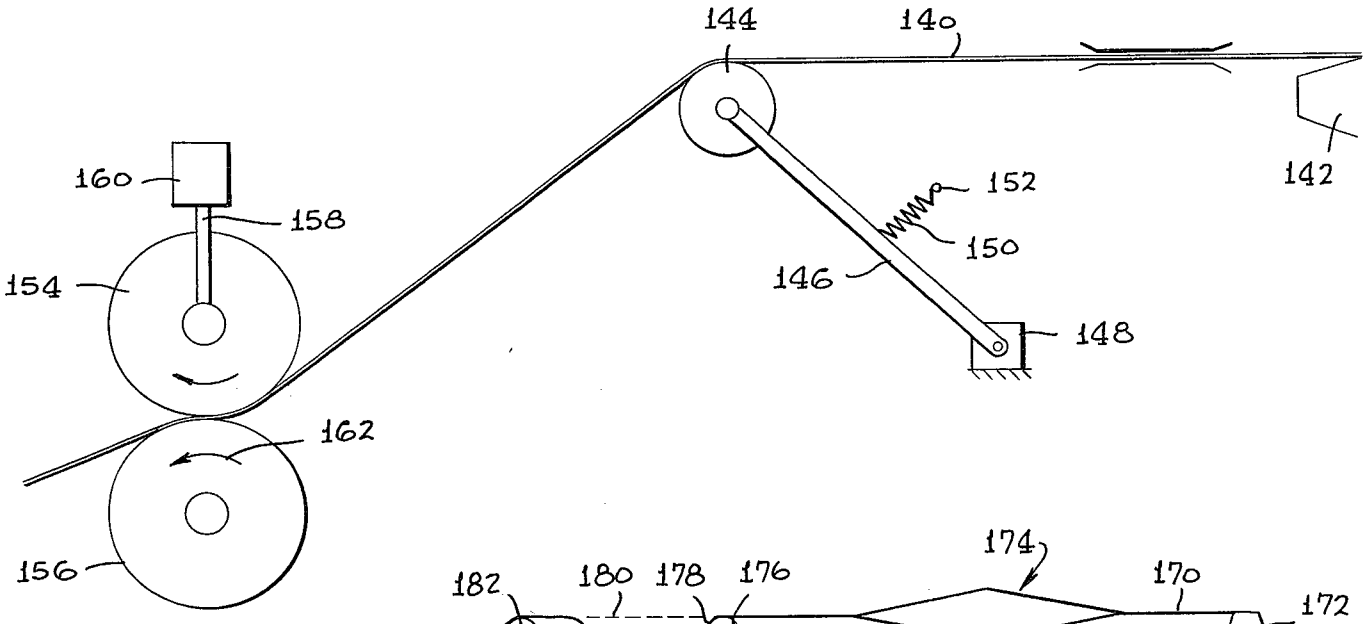
FIG. 11 is a side view of one arrangement for varying the tension on yarns used to secure a fabric laminate together.

One arrangement for providing the desired tension in the Z direction yarns is shown in FIG. 11. FIG. 11 depicts one of a plurality of Z direction yarns 140 which are advanced in spaced-apart, parallel relation from a plurality of creels 142 or equivalent apparatus for supplying the yarns 140. The yarns 140 extend from the creels 142 over a first roller 144 pivotably coupled to the outer end of a lever arm 146. The opposite end of the lever arm 146 is pivotably coupled to a mounting block 148. An intermediate portion of the lever arm 146 is coupled to one end of a spring 150 having the opposite end thereof coupled at a stationary mount 152.

From the roller 144 the yarns 140 extend to a region between an opposed pair of rollers 154 and 156. The roller 156 is fixedly rotatably mounted. The roller 154 however is rotatably mounted to a frame 158 which is suspended from air cylinders 160. The roller 156 is coupled to an arrangement (not shown in FIG. 11) for rotatably driving the roller 156 in the direction shown by an arrow 162. When the air cylinders 160 are actuated, the frame 148 forces the roller 154 toward the roller 156 to engage the yarn 140 therebetween. With the roller 156 rotatably driven, the yarns 140 are fed toward the fabric so that little or no tension exists in the Z direction yarns. As previously noted, this condition is desirable just prior to positioning of the yarns in the needle hooks and also as the needles pull loops of the yarn through the fabric. With the air cylinders 160 turned off, the roller 154 is allowed to move away from the roller 156 slightly so as to release the tight gripping of the yarns 140 by the rollers 154 and 156. At the same time the roller 144 under the urging of the spring 150 tensions the Z direction yarns 140. This results in the Z direction yarns 140 being tensioned at the fabric, which condition as previously noted is desired where the previously inserted yarn loop is to be tightened around a newly formed loop.

Yarns of graphite, carbon, quartz and ceramic materials typically used to make three-dimensional thick fabrics of the type contemplated by the invention are relatively fragile and have relatively poor abrasion resistance. While providing slack before positioning the Z direction yarn in the needle hook eliminates sliding friction in the hook, some friction on the yarn still occurs when the yarn is pulled through the fabric. To minimize damage to the Z direction yarns from this friction it may be desirable or necessary to provide protection for the yarn. This may be accomplished by treating the yarn with a lubricating finish such as polyvinyl alcohol, Teflon or starch-oil. For extremely high friction conditions with fragile yarn, it may be necessary or desirable to serve a fine denier second yarn on the outside of the Z direction yarn. The serving involves spirally wrapping the second yarn such as nylon or rayon around the Z direction yarn either in one direction or in both directions if necessary. Upon completion of the fabric, the finishes or serving can be removed by chemical or thermal means if required.

Figure 12:
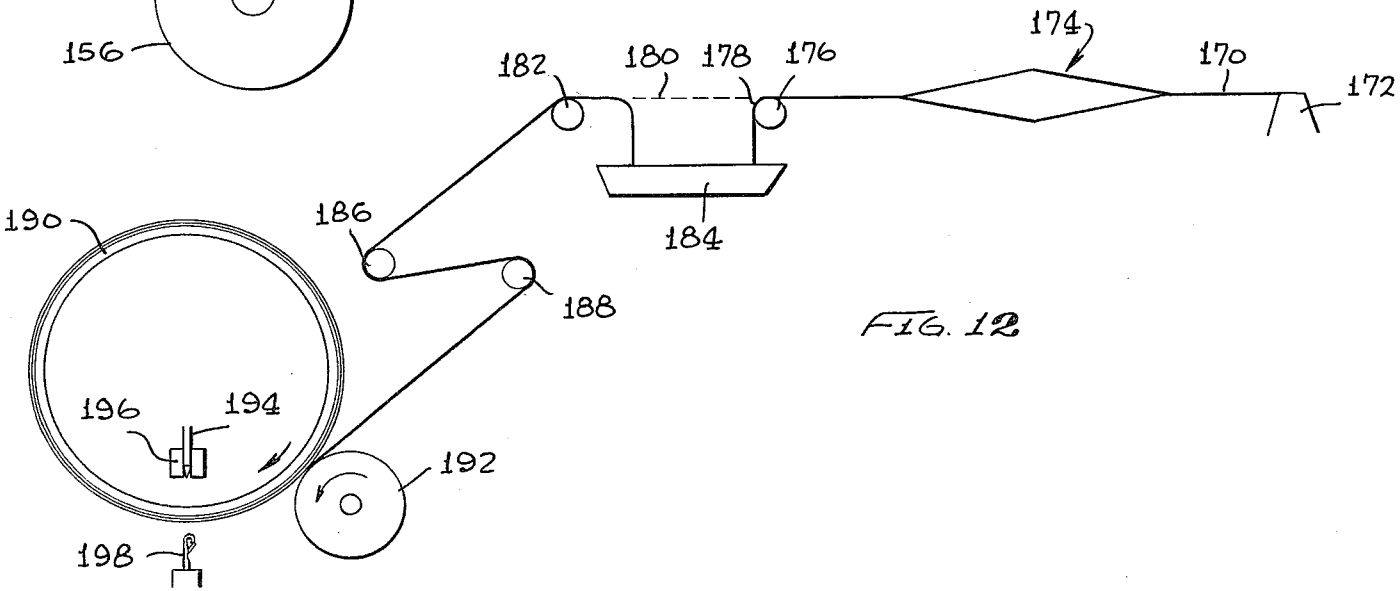
FIG. 12 is a schematic view of one arrangement for making a three-dimensional thick fabric in accordance with the invention which has a complex shape and a varying diameter.

FIG. 12 depicts an arrangement in accordance with the invention for making a three-dimensional thick fabric in the form of a hollow, circular configuration of varying diameter. In making woven fabric shapes such as cones, ogives and the like, prior art methods often involve the weaving of lay flat tubes in such a manner that the outermost warp yarns of the tubes are programmed to drop out of the weaving sequence. The tubes are therefore of progressively changed diameter and when opened take on the desired shape. The fill yarns of the expanded part are continuous and become the circumferential yarns of the shape. The warp yarns become the longitudinal yarns of the expanded part and the dropped off yarns appear along definite lines on the surface of the part. The process requires the use of a Jacquard type of pattern control and where applicable for making parts of appreciable thickness, successive parts are nested upon each other to reach the desired thickness.

The prior art process described above has several disadvantages when applied to very thick parts. At least one punched card is necessary for each pick or filling yarn and large parts may require as many as 10,000 to 20,000 cards. In order to prepare the fabric for an extremely thick part, it has been necessary to program a series of parts, each requiring a separate program to accommodate a relatively small increment of the overall part thickness. The design effort, in addition to the program card cost soon reaches a very high level. Additional labor costs are incurred when the woven shapes are nested on or over the other by hand, and each successive piece must be manipulated to remove wrinkles. The lay flat technique requires the use of a fly shuttle loom and some of the yarns under consideration are not well suited to be woven on that type of loom because of their fragility. The fragile yarns are better suited for use on a rapier type loom.

A further disadvantage of the lay flat technique is that the discontinued warp yarns appear on the fabric as definite lines and this requires additional manipulation in nesting the successive layers to prevent these lines from locating one over the other in the completed layup.

FIG. 12 depicts an arrangement in accordance with the invention for making three-dimensional thick fabrics of hollow, circular configuration and of complex shape such as where the fabric has a varying diameter. A plurality of longitudinal warp yarns 170 supplied from creels 172 are directed into a weaving region 174. In the weaving region 174 the warp yarns 170 are separated and are interwoven with transverse fill yarns. The longitudinal warp yarns 170 are taken up by a roller 176 as weaving progresses in the region 174.

The fabric woven in the region 174 differs from conventionally woven fabric in that the fill yarn length and the warp yarn length are programmed at each pick to conform to the shape of the multi-ply part to be made. The warp length programming which is required by the varying diameter of the part to be made is provided by the design of the take up roller 176. The filling length variation, which is also required by the varying diameter of the part to be made, is provided by interweaving some of the transverse fill yarns with selected longitudinal warp yarns of the fabric being formed across only a portion of the width of the fabric as described hereafter in connection with FIGS. 15–17. The length of the interweavings of the various ones of the fill yarns across the width of the fabric are varied by conventional pattern control devices. It will be understood that the limitations of the programming arrangement, particularly with respect to the points at which selected fill yarns are discontinued, will introduce some minor variations in density across the face of the fabric. These variations tend to cancel out or become partially annulled as successive warps or plies are wound on the form and the completely wound laminate is substantially uniform in density.

The weaving region 174 produces a woven fabric 178. The woven fabric 178 may be taken directly through a path 180 shown in dotted outline and over a guide 182 for wrapping on a form. More typically, however, the fabric 178 is directed into a box 184 where the fabric is folded and stored for later supply to the guide 182.

From the guide 182 the fabric 178 is directed around a guide 186 and around another guide 188 to a hollow, generally circular form 190. A plurality of wheels 192, one of which is shown in FIG. 12, can be used to secure the fabric 178 as it is wound around the form 190 a desired number of times. A plurality of pointed rods 194 of a hole forming mechanism 196 are disposed within the form 190 for repeated penetration of the laminate of fabric plies on the outside of the form 190 in the manner previously described. A plurality of needles 198 extend through the holes formed by the rods 194 to secure Z direction yarns in the manner previously described.

Figures 13, 14, 18:
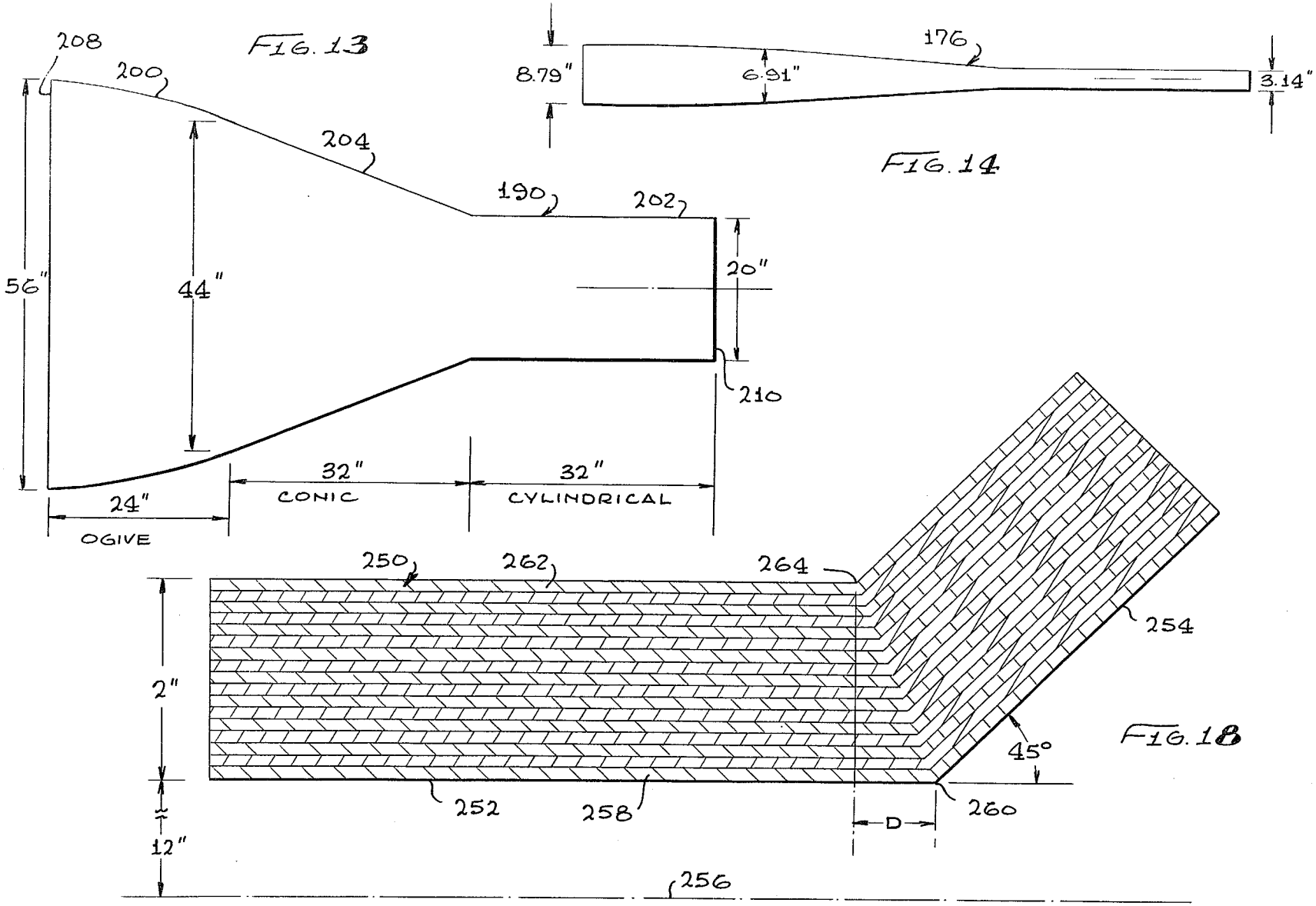
FIG. 13 is a sectional view of a form used in the arrangement of FIG. 12 to make a three-dimensional thick fabric of one particular complex shape.
FIG. 14 is a sectional view of a take up roller used in the arrangement of FIG. 12 to weave the fabric in a shape corresponding to the shape of the form of FIG. 13.
FIG. 18 is a sectional view of a portion of a three-dimensional thick fabric illustrating the problem of a shifting point of changing diameter as plies of fabric are wound onto a form to form the fabric.

FIG. 13 shows the form 190. The form 190 has a shape typical of certain applications of the three-dimensional thick fabrics such as where they are to be used as heat shields. The form 190 has an ogive-shaped portion 200 at one end thereof, a cylindrical portion 202 at the opposite end thereof, and a portion 204 in the form of a conical section disposed between the ogive-shaped portion 200 and the cylindrical portion 202. The ogive-shaped portion 200 has a diameter of 56" at a left end 208 of the form 190 and decreases in curvilinear fashion over a length of 24" of the form 190 to a final diameter of 44". The conical section 204 begins at the point of 44" diameter and decreases linearly in diameter to a final diameter of 20" over a 32" portion of the length of the form 190. The cylindrical shaped portion 202 has a constant diameter of 20" and is 32" long between the left hand end thereof and the right hand end thereof at a right end 210 of the form 190.

Referring again to FIG. 12 it will be apparent that the portions of the form 190 of smaller diameter require that the longitudinal warp yarns of the fabric to be woven and wound thereabout be drawn through the weaving region 174 at a slower rate compared with the warp yarns to be wound around the portions of the form 190 of larger diameter. This speed differential is accomplished by means of the roller 176 which draws the warp yarns from the creels 172 and which is shown in detail in FIG. 14. The roller 176 which has a length equal to that of the form 190 has a varying diameter along the length thereof proportional to the varying dimaeter of the form 190. The ratio of the cylindrical portion 202 of the form 190 to the largest diameter of the ogive-shaped portion 200 is 20/56 or 1:2.8. The end-to-end ratio of the roller 176 shown in FIG. 14 is 3.14/8.79 or 1:2.8. At each point along the length of the roller 176, the diameter has this same ratio to its corresponding position on the form 190. The selection of the ratio is somewhat arbitrary, it being necessary to select a roller which will fit the space available at the output of a loom. The shape of the take up roller 176 insures that the length of the woven fabric 178 at every position across the width thereof is proportional to the circumference of the part to be formed on the form 190 at that position.

Because of the varying diameters of the form 190 and the roller 176 the spacing between sucessive fill yarns woven into the fabric 178 will vary so that the fill yarns are relatively close together at the cylindrical shaped portion 202 and farther apart at the other portions of larger diameter. This condition is compensated for by a technique shown in FIG. 15 in which selected ones of the fill yarns are interwoven with the warp yarns across only a portion of the width of the woven fabric being formed. These fill yarns are floated over the rest of the woven fabric and then are trimmed away. The particular arrangement shown in FIG. 15 which represents a portion of the woven fabric shaped like the cross sections of the form 190 and the roller 176 is accomplished using a Jacquard control in conjunction with a 56 pick repeat. Only 56 Jacquard cards are needed.

Figure 15:
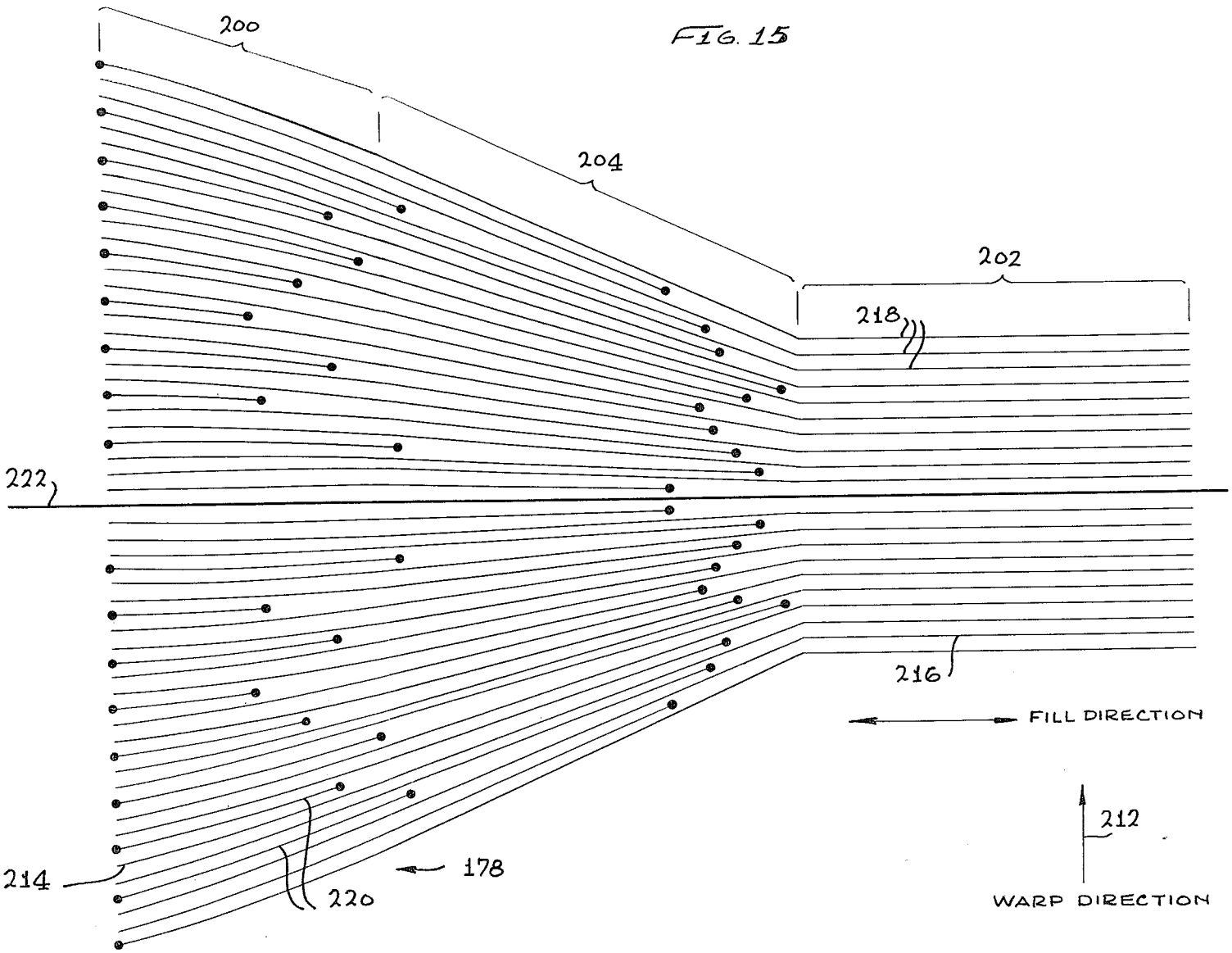
FIG. 15 is a plan view of a portion of a woven fabric illustrating one manner for varying the shape or density of the fabric to provide for a three-dimensional thick fabric having the shape represented by the form of FIG. 13.

In the example of FIG. 15 the longitudinal warp yarns are eliminated for simplicity and only the transverse fill yarns are shown. The warp direction which is also the direction in which the woven fabric is advanced is represented by an arrow 212. The fill yarns extend between a left edge 214 of the woven fabric 178 and a right edge 216. A first plurality of fill yarns 218 extend across the entire width of the fabric 178 between the opposite edges 214 and 216. The fill yarns 218 are interwoven with the warp yarns across the entire width of the fabric 178. A second plurality of fill yarns 220 are interwoven with the warp yarns across only a portion of the total width of the fabric 178. The lengths of the yarns 220 vary in accordance with the programmed Jacquard control of the weaving operation. All of the fill yarns 218 and 220 originate at the common left edge 214 of the fabric 178. It will be seen in FIG. 15 that some of the fill yarns 220 terminate before reaching the junction between the ogive-shaped portion 200 and the conical section 204. Still others of the fill yarns 220 extend slightly beyond that junction and into the conical section 204. Others of the fill yarns 220 extend across the entire ogive-shaped portion 200 and a substantial portion of the conical section 204. The pattern formed by the fill yarns 220 is symmetrical with respect to an axis 222 extending through the portion of the woven fabric 178 shown in FIG. 15.

Figure 16:
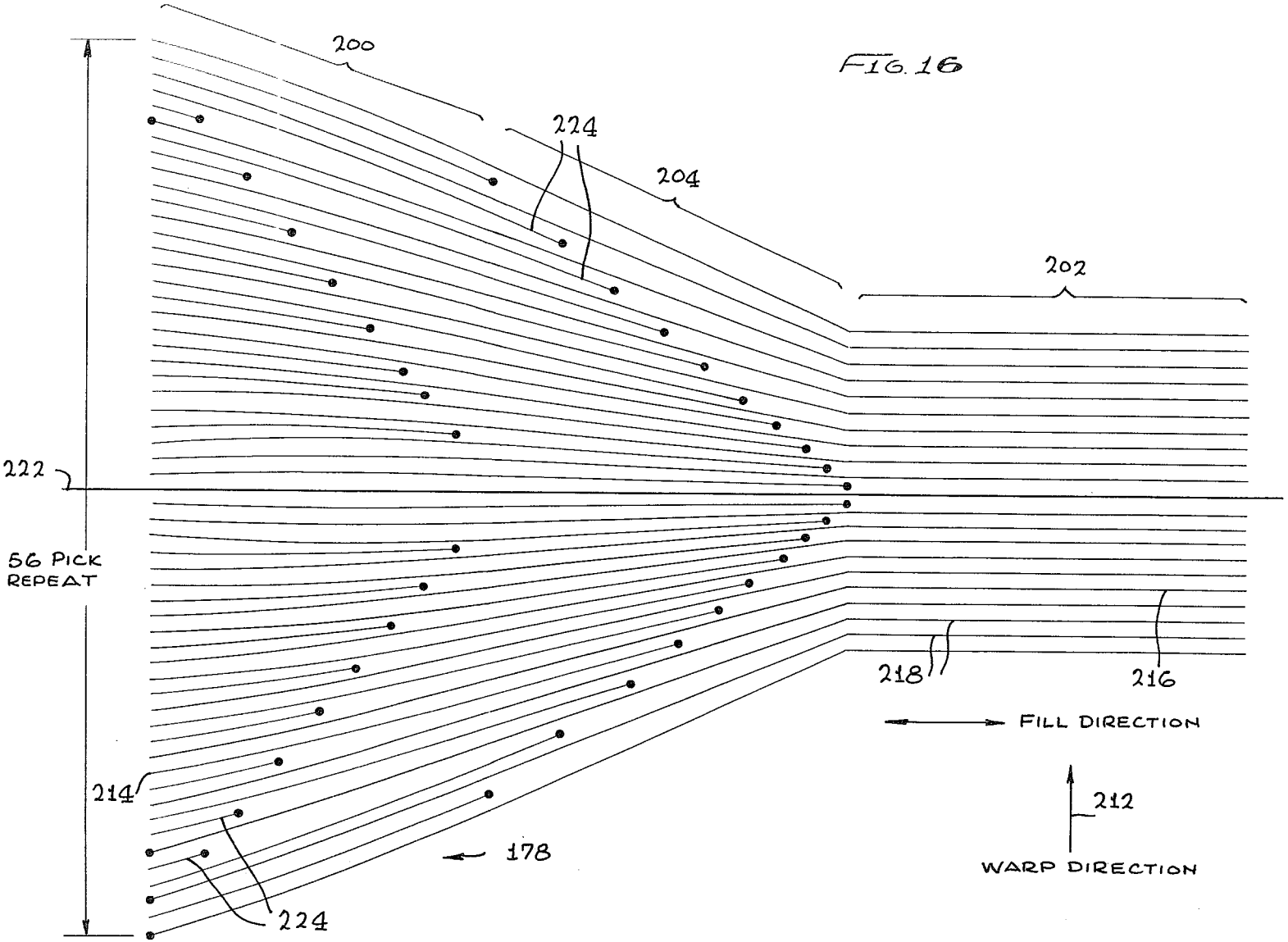
FIG. 16 is a plan view of a portion of a woven fabric similar to that of FIG. 15 but illustrating the programming of an alternative weaving technique.

FIG. 16 depicts an arrangement similar to that of FIG. 15. The primary difference between FIGS. 15 and 16 is that the arrangement of FIG. 16 employs in addition to the first plurality of fill yarns 218 a second plurality of fill yarns 224 having lengths which vary directly with the distance from the axis 222. It will also be noted that the second plurality of fill yarns 224 forms two different arrangements, the first of which terminates within the ogive-shaped portion 200 and the second of which terminates within the conical section 204.

Figure 17:
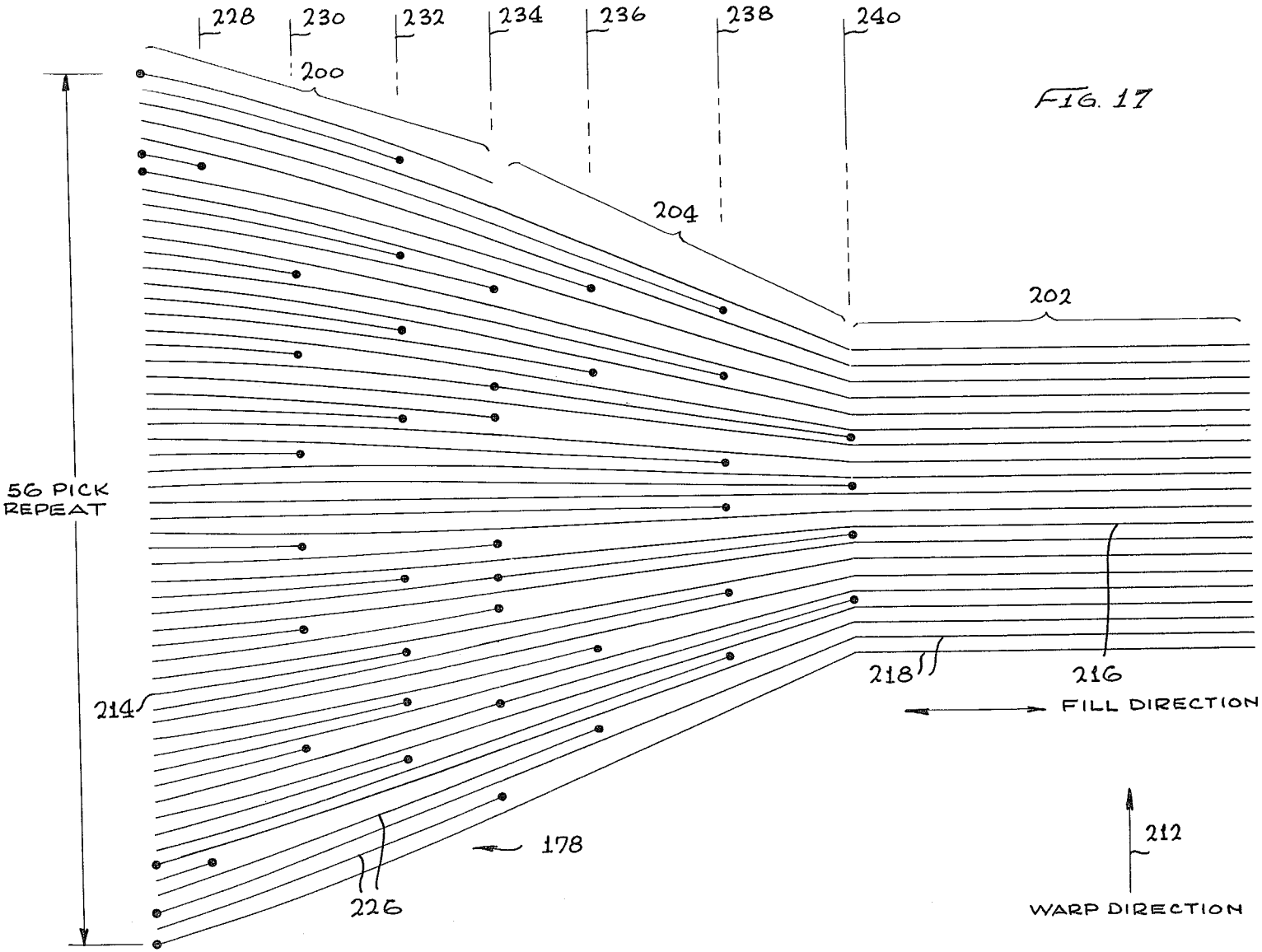
FIG. 17 is a plan view of a portion of a fabric similar to FIG. 15 but illustrating the programming of a further alternative weaving technique.

A further alternative weaving technique is shown in FIG. 17. In the arrangement of FIG. 17 the locations at which the fill yarns are floated is programmed by means of a Dobby pattern control. The arrangement shown has a 56 pick repeat and uses a Dobby head having 16 harnesses. With this type of control the points at which the fill yarns are discontinued or floated lie along definite lines. With the Jacquard type of control employed in the examples of FIGS. 15 and 16, the points at which the fill yarns are dropped can be made to occur in more random fashion. Thus the arrangement shown in FIG. 17 includes the first plurality of fill yarns 218 and a second plurality of fill yarns 226 which terminate at one of a series of axes 228, 230, 232, 234, 236, 238 and 240 extending in the warp direction. The axis 234 lies at the interface between the ogive-shaped portion 200 and the conical section 204. The axis 240 lies at the interface between the conical section 204 and the cylindrical shaped portion 202.

Special problems may arise in weaving a fabric which is ultimately wound many times around a form to create a relatively thick fabric of varying diameter. The problems can become particularly severe where there is a sudden and substantial change in diameter such as at the interface between a cylinder and a conical section. Such a problem is illustrated in FIG. 18 which depicts a portion of a three-dimensional thick fabric 250. The fabric 250 is wound from many individual fabric plies so as to have a thickness of approximately 2". A cylindrical portion 252 has an inner radius of approximately 12". The cylindrical portion 252 interfaces with a portion in the shape of a conical section 254 forming an angle of approximately 45° with the cylindrical portion 252. Because of the substantial thickness of the fabric 250 and the rather severe corner created by the 45° angle, the point of interface between the cylindrical portion 252 and the conical section 254 shifts along a central axis 256 for the fabric 250 with each additional fabric ply in a direction from right to left as viewed in FIG. 18. Thus, a first fabric ply 258 changes direction at a point 260. At the other extreme an outermost fabric ply 262 changes direction at a point 264 displaced a distance D from the point 260 relative to the central axis 256.

Difficulties in winding the fabric 250 of FIG. 18 arise where the fabric is continuously woven so as to change direction at the point 260 across the width of the fabric as in the case of the first fabric ply 258. The shifting to the left of the point of direction change with each additional ply makes it difficult to wind the succeeding plies onto the form in a uniform and orderly fashion so as to form a fabric having a neat and orderly 45° change in direction. If the roller corresponding to the roller 176 of FIG. 12 and which is used to vary the speed of the longitudinal warp yarns during weaving is assumed to have a diameter of 8", meaning a radius of 4", then a diameter ratio of 1:3 is formed between the roller and the form. However, the fully wound diameter of the fabric 250 is 28" and this forms a ratio of 1:3.5 with the 8" diameter of the roller. Thus, the diameter of the cylindrical portion of the roller must be increased to $24/28 \times 8$ or 9.33" as the fabric 250 is formed. An arrangement for accomplishing this is shown in FIGS. 19 and 20.

Figure 19:
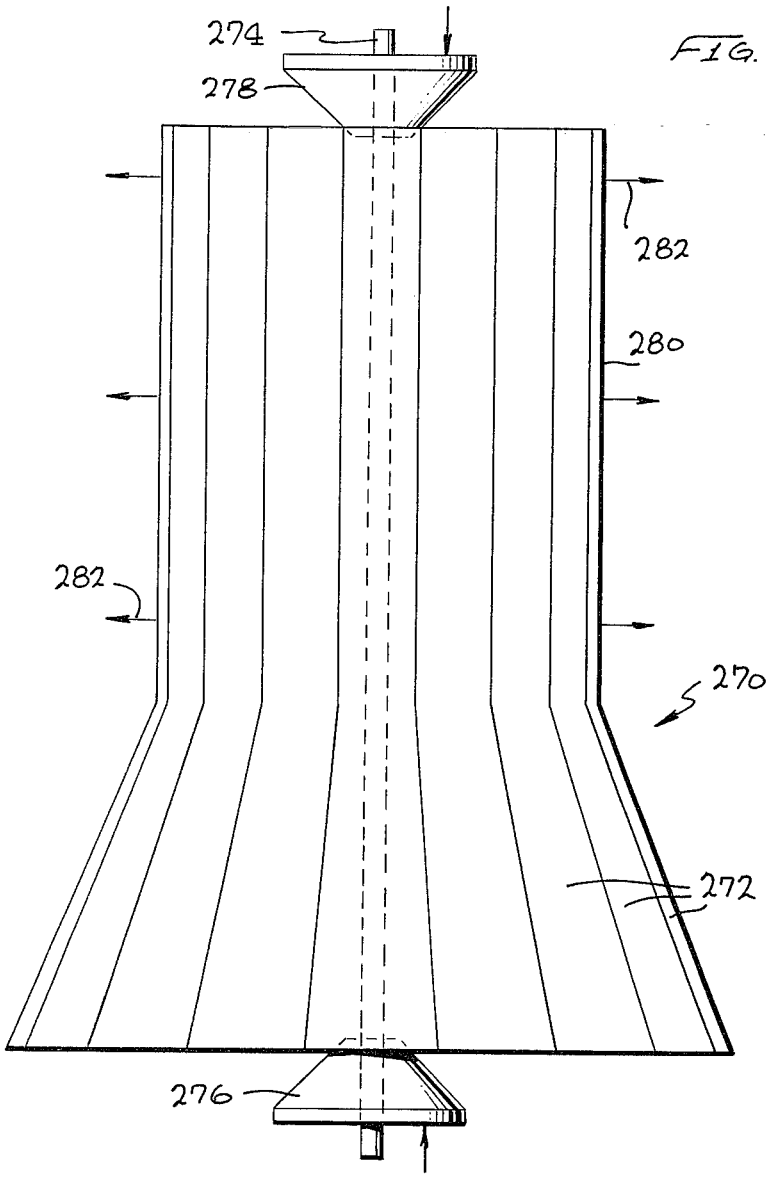
FIG. 19 is a top view of a particular take up roller arrangement for use in weaving the fabric of FIG. 18, which roller arrangement solves the problem presented by the particular fabric shape of FIG. 18.
Figure 20:
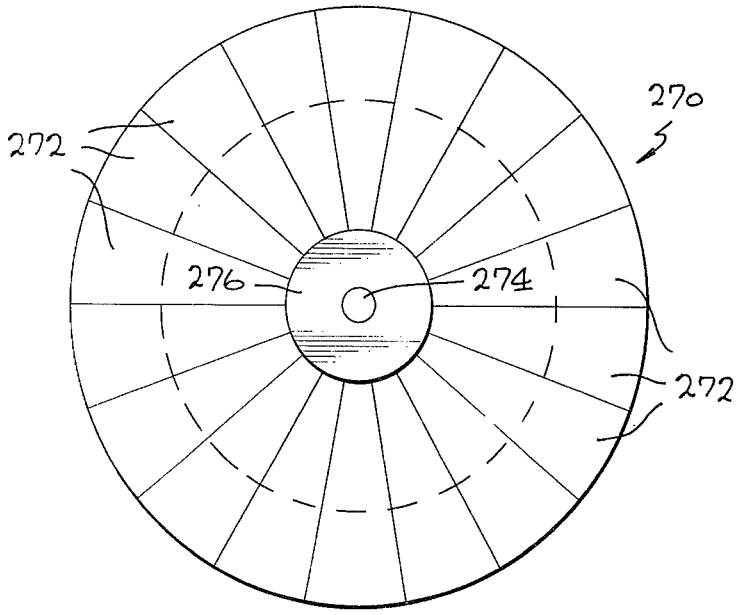
FIG. 20 is an end view of the roller arrangement of FIG. 19.

FIGS. 19 and 20 illustrate a take up roller 270 comprising 18 different wedge-shaped sectors 272 disposed around a central shaft 274. A pair of nuts 276 and 278 threadedly engage the shaft 274 at the opposite ends thereof adjacent the opposite ends of the roller 270. The nuts 276 and 278 have varying outer diameters so as to be tapered and to engage the inner edges of the sectors 272. Movement of the nuts 276 and 278 toward one another along the shaft 274 causes the nuts to engage the various sectors 272 and force the sectors outwardly and away from the shaft 274. This causes the portions of the sectors 272 within a cylindrical section 280 of the roller 270 to move outwardly as shown by arrows 282.

During winding of a woven fabric onto a form to form the fabric 250 as shown in FIG. 18, the nuts 276 and 278 are slowly advanced toward one another so as to gradually increase the diameter of the cylindrical section 280 from 8" to the required 9.33" as the last ply is wound on the fabric 250. The increased diameter of the roller 270 increases the speed at which the fabric moves through the loom, resulting in fewer picks per inch of the fill yarns as the diameter of the cylindrical portion 280 is increased. If necessary, this condition can be compensated for by reducing the speed of the roller 280.

For some shapes such as that shown in FIG. 21, it is not necessary to use a variable diameter roller of the type shown in FIGS. 19 and 20. FIG. 21 illustrates a portion of a fabric 290 comprising a cylindrical portion 292 and a portion in the form of a conical section 294. The conical section 294 forms an angle of 60° with the cylindrical portion 292 at the interface therebetween. Under these conditions the layers of fabric nest properly at the interface, but each fabric layer rides higher than the preceding one by an amount equal to twice the thickness of the fabric. Thus, a first fabric ply 296 has a thickness T within the conical section 294 and a thickness 2T within the cylindrical portion 292. This additional thickness can be woven into the appropriate portion of the width of the fabric by increasing the warp yarn diameter in the area to have increased thickness. In any event the point of direction change of each ply does not vary to one side or the other, and accordingly a roller of variable diameter is not required.

It will be recalled from FIG. 12 that the fabric 178 therein is wound onto the form 190 with the help of the wheel 192. The form 190 and the wheel 192 are shown in FIG. 22 together with three additional wheels 300, 302 and 304. Because the form 190 has a changing diameter across the length thereof, it is not possible to use a cylindrical roller to assist in rolling the fabric onto the form. Instead, the wheels 192, 300, 302 and 304 are used. In the example of FIG. 22 each of the wheels 192, 300, 302 and 304 has a diameter proportional to the diameter of the form 192 at the point at which the wheel contacts the fabric formed on the outer surface of the form 190. This enables the wheels 192, 300, 302 and 304 to be driven at the same rotational speed and therefore by a common driving source (not shown in FIG. 22).

FIG. 12 shows a plurality of needles 198 mounted adjacent the outside of the form 190. The various needles 198 as they extend along the length of the form 190 are shown in FIG. 23. Because of the varying diameter of the form 190 the needles 198 cannot be mounted along the length of a single element as in the case of FIGS. 8 and 9 where cylindrical parts are being made. Instead, the needles 198 are broken into different segments 306, 308, 310 and 312. By breaking the arrangement of needles 198 up into the different segments, the needles are better able to conform to the outer surface of the form 190. The segment 306 spaces all of the needles 198 thereof equidistantly from the cylindrically shaped portion 202 of constant diameter. The conical section 204 has a diameter which changes at a constant rate along the length thereof, enabling the segment 308 to dispose the various needles 198 thereof equidistantly from the outer surface of the form 190. Because the diameter of the ogive-shaped portion 200 changes in curvilinear fashion, the two different segments 310 and 312 are required to dispose the various needles 198 thereof by substantially equal distances from the outer surface of the form 190. The various pointed rods 194 of the hole forming mechanism 196 of FIG. 12 mounted on the inside of the form 198 are preferably broken into segments in the same manner as the needles 198.

FIGS. 24 and 25 depict the details of the form 190. The form 190 includes a generally cylindrically shaped frame 316 having a longitudinal slot 318 along an upper portion thereof as seen in FIG. 24. Elongated rollers 320 are rotatably mounted about the outside of the frame 316 by plurality of roller mounts 322. The rollers 320 are spaced apart about the outer surface of the frame 316 and are rotatable about the longitudinal axes thereof which extend in a direction generally parallel to a central axis 324 for the form 190. Because of the varying diameter of the form 190 and therefore of the frame 316, the roller mounts 322 curve so as to conform to the outer surface of the frame 316. As shown in FIG. 25 the various rollers 320 are of very short length compared to the length of the form 190, and a plurality of the rollers 320 are rotatably mounted in spaced-apart relation along the length of each roller mount 322.

The various rollers 320 enable fabric to be wound onto the form 190 such as by use of the wheels 192, 300, 302 and 304 shown in FIG. 22. Generally, the fabric must be slowly and carefully guided around the outer surface of the form 190 for the first several plies, following which the wheels or equivalent driving arrangements can be used to continue advancing the fabric around the form 190 in automated fashion.

The frame 316 of the form 190 is mounted in stationary fashion by a plurality of support elements 326 extending inwardly from the inner walls of the frame 316 to a central shaft 328. The central shaft 328 typically extends beyond the opposite ends of the form 190 to provide a means for mounting the form.

A pair of guides 330 and 332 mounted at the opposite sides of the slot 318 at the top of the frame 316 support the fabric and provide a slot 334 through which the fabric can be perforated and sewn. The needles 198 are shown in FIG. 24. The hole forming mechanism 196 which is positioned adjacent the slot 334 at the inside of the fabric is omitted from FIG. 24 for clarity.

FIGS. 26 and 27 depict an arrangement for making a fabric in the shape of a conical section. FIG. 26 shows a form 340 comprised of a plurality of tapered rollers 342. The rollers 342 which extend along the entire length of the form 340 are spaced apart about the conically shaped form 340. In the present example one or more of the tapered rollers 342 are driven to wind the fabric around the form 340. In FIG. 26 the two rollers 342 shown therein are coupled to beveled gears 344. The beveled gears 344 are driven by gears 346 mounted on drive shafts 348. The rollers 342 are taped along the length thereof so as to have a varying diameter which is proportional to the diameter of the form 340 along the length thereof.

The woven fabric as it comes from the loom is folded into a fabric box 350 shown in FIG. 27, and the fabric box 350 is positioned adjacent the form 340. The fabric is then advanced through an opposite pair of guides 352 and 354 which serve to tension the fabric both laterally and longitudinally. The guides 352 and 354 are controlled by sensors 356 and 368 disposed at opposite edges 360 and 362 respectively adjacent the form 340. The sensors 356 and 358 maintain an even edge as the fabric is wound onto the form 340. In some instances a layer of fabric will tend to ride a small increment higher on the form 340 and the position of the sensors 356 and 358 is programmed to control this action.

The pointed rods 44 in the hole forming mechanism 42 of FIGS. 1 and 2 have been found to penetrate fabric laminates with relative ease to form rows of holes therein where the fabric laminate is not too thick or tightly woven. Where the fabric laminate is too thick or too tightly woven or both, an alternative hole forming mechanism 380 is shown in FIG. 28 may be employed.

The hole forming mechanism 380 is like the mechanism 42 of FIGS. 1 and 2 in that it employs a plurality of pointed rods 382 arranged into a row and mounted in generally parallel, spaced-apart relation along the length of a mounting bar arrangement 384. The individual rods 382 are received within different bushings 386 mounted in spaced-apart relation along the length of a rod guide bar 388. When the mounting bar arrangement 384 is moved toward and away from the rod guide bar 388, pointed tips 390 at the upper ends of the rods 382 extend upwardly from the rod guide bar 388 as the rods 382 are moved through the bushings 386 in the guide bar 388. Periodically, the mounting bar arrangement 384 is moved upwardly toward the rod guide bar 388 to push the rods 382 through the entire thickness of a fabric to form a row of holes.

Unlke the hole forming mechanism 42 of FIGS. 1 and 2 in which the rods 44 are fixedly mounted on the mounting bar 46, in the arrangement of FIG. 28 the various rods 382 are rotatably mounted and driven within the mounting bar arrangement 384. The mounting bar arrangement 384 includes an upper elongated frame 392 having a plurality of bearings 394 spaced along the length thereof for rotatably mounting the rods 382. The mounting bar arrangement 384 further includes a lower elongated frame 396 having a plurality of bearings 398 for rotatably mounting the rods 382. Mounted on each of the rods 382 between the bearing 394 and the bearing 398 is a gear 400. Adjacent pairs of the gears 400 engage an intermediate idler gear 402 rotatably mounted therebetween by a shaft 404 having the opposite ends thereof mounted within the elongated frames 392 and 396. The shaft 404 which is the second one from the left end of the hole forming mechanism 380 shown in FIG. 28 extends downwardly from the elongated frame 396 and into a collar 406 which couples the shaft 404 to a shaft 408. The shaft 408 is coupled to be rotatably driven.

With the shaft 408 rotatably driven, the collar 406 coupled thereto drives the coupled shaft 404 and the included gear 402. The gear 402 drives the adjacent gears 400 and all other gears 400 via the gears 402. This causes the rods 382 to rotate within the bushings 386 and the bearings 394 and 398 as the mounting bar arrangement 384 is reciprocated toward and then away from the rod guide bar 388. It has been found that by rotating the rods 382 as they are inserted through the thickness of a fabric, the rods pass much more easily through the fabric to form relatively straight holes. This is particularly true in the case of relatively thick fabrics and fabrics which have relatively high density because of the tightness with which the X and Y yarns of the various plies thereof have ben woven. The straighter holes within the fabric facilitate insertion of the needles through the holes.

Occasionally, it may be necessary or desirable to support the fabric as it is being penetrated by the pointed rods, even where a rotating rod arrangement such as is shown in FIG. 28 is used. This is particularly true where the fabric is not otherwise supported close to the row of holes being formed therein or where the fabric is relatively thin and flexible. If the fabric flexes too much under the pressure of the rods causing the various plies of the fabric to slide relative to each other, then even though the rods have no particular difficulty in penetrating the fabric to form the holes, the resulting holes may form an angle other than the desired angle of the hole with the broad surfaces of the fabric when the fabric subsequently flattens out. This may make subsequent insertion and retraction of the needles difficult or impossible. Support of a fabric during penetration by the rods to form holes therein may be accomplished using any appropriate arrangement such as one in which a support frame member is disposed against the fabric opposite the side of the fabric being penetrated by the rods. The support frame member may be located adjacent but to the side of the penetrating rods to permit the rods to pass freely through the fabric and beside the support frame member. Alternatively, the support frame member may be apertured with the rods passing through the apertures in the support frame member as they complete penetration of the fabric.

While the invention has been particularly shown and described with reference to preferred embodiments thereof, it will be understood by those skilled in the art that the foregoing and other chages in form and details may be made therein without departing from the spirit and scope of the invention.

What is claimed is:

1. A method of making a three-dimensional thick fabric comprising the steps of:

forming a laminate from individual fabric plies, the thicknesses of the fabric plies combining to define a thickness of the laminate between opposite broad surfaces of the laminate;

forming a plurality of holes through the thickness of the laminate, the holes extending in a pattern across substantially the entire opposite broad surfaces of the laminate; and passing a needle through each of at least a substantial number of the holes in the laminate to secure a yarn on the opposite side of the laminate and pull the yarn back through the hole with the needle to form a loop in the yarn, the loops from adjacent holes being interconnected.

2. The invention set forth in claim 1, wherein the step of forming a plurality of holes through the thickness of the laminate includes the steps of providing a row of generally parallel, spaced-apart pointed rods and repeatedly forcing the pointed rods through the thickness of the laminate while stepping the rods along the laminate between each forcing of the pointed rods through the thickness of the laminate to form plural rows of holes in the laminate which extend across at least a substantial portion of the opposite broad surfaces of the laminate.

3. The invention set forth in claim 2, wherein the step of passing a needle through each of at least a substantial number of the holes in the laminate comprises the steps of providing a row of generally parallel, spaced-apart needles and passing the needles through the holes in each row of holes to secure a plurality of yarns on the opposite side of the laminate and pulling the yarns back through the holes with the needles to form loops in the yarns, each loop passing through a loop in the same yarn previously formed in an adjacent hole.

4. The invention set forth in claim 3, wherein the needle has a looped end which is closed around the yarn to pull the yarn back through each hole to form a loop in the yarn and which is opened to release the loop from the needle before the needle is passed through the next hole and each loop in the yarn passes through a loop previously formed in an adjacent hole.

5. The invention set forth in claim 1, including the further step of advancing a predetermined length of the yarn from a supply for the yarn in preparation for each pulling of the yarn back through the hole with the needle to form a loop in the yarn.

6. The invention set forth in claim 5, wherein the step of advancing a length of the yarn includes the steps of providing a guide arm having a eye therein for receiving the yarn and a clamp for selectively clamping the yarn to the guide arm, closing the clamp, moving the guide arm to advance a length of the yarn, and unclamping the clamp from the yarn to allow the yarn to pass freely through the eye.

7. The invention set forth in claim 1, further comprising the step of securing each loop in the yarn formed by pulling the yarn back through the hole with the needle until the needle is passed through the loop and through the next hole.

8. The invention set forth in claim 7, wherein the step of securing each loop comprises the steps of providing a doffing point, extending the doffing point into each loop in the yarn formed by pulling the yarn back through the hole with the needle and removing the doffing point from the loop as passage of the needle through the next hole is begun.

9. A method of making a three-dimensional thick fabric of curved, hollow configuration comprising the steps of:

providing a form of generally circular configuration;

winding a length of fabric a selected number of times around the form to form a laminate, the laminate having opposite inner and outer broad surfaces;

forming holes in the laminate across at least substantial portions of the inner and outer surfaces; and pulling loops of a plurality of yarns through the holes so that the loops interlock with loops pulled through adjacent holes.

10. The invention set forth in claim 9, wherein the step of winding a length of fabric comprises winding the length of fabric around the form a selected number of times in each of a plurality of successive steps, and the step of pulling loops of a plurality of yarns comprises pulling loops of the plurality of yarns through a different set of holes during the successive steps of winding the length of fabric around the form.

* * * * *

UNITED STATES PATENT AND TRADEMARK OFFICE

CERTIFICATE OF CORRECTION

PATENT NO. : 4,331,091

DATED : May 25, 1982

INVENTOR(S) : Leon Parker et al

It is certified that error appears in the above-identified patent and that said Letters Patent are hereby corrected as shown below:

Column 6, line 37, after "Z", "acis" should read --axis--. Column 9, line 17, after "position" and before "in" insert --shown--. Column 14, line 4, after "successive" and before "or", "warps" should read --wraps--; line 57, before "of" (first occurrence), "dimaeter" should read --diameter--. Column 20, line 23, after "other" and before "in", "chages" should read --changes--.

Signed and Sealed this

*Twenty-first* Day of *September 1982*

[SEAL]

*Attest:*

GERALD J. MOSSINGHOFF

*Attesting Officer*

*Commissioner of Patents and Trademarks*